US006915737B2

(12) United States Patent
Hirano et al.

(10) Patent No.: US 6,915,737 B2
(45) Date of Patent: Jul. 12, 2005

(54) INK SUPPLY AMOUNT CONTROL METHOD AND APPARATUS FOR PRINTING PRESS

(75) Inventors: Masahiro Hirano, Ibaraki (JP); Toshikazu Tomita, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/737,068

(22) Filed: Dec. 15, 2003

(65) Prior Publication Data

US 2004/0123759 A1 Jul. 1, 2004

(30) Foreign Application Priority Data

Dec. 26, 2002 (JP) ..... 2002-376551

(51) Int. Cl.[7] ..... B41J 27/00
(52) U.S. Cl. ..... 101/100; 101/484; 101/483
(58) Field of Search ..... 101/484, 365, 101/100, 483

(56) References Cited

U.S. PATENT DOCUMENTS 4,784,060 A 11/1988 Weisgerber et al.
5,921,184 A * 7/1999 Sugiyama et al. ..... 101/484
5,988,067 A * 11/1999 Ishida et al. ..... 101/484
6,006,662 A * 12/1999 Ishida et al. ..... 101/141
6,202,554 B1 * 3/2001 Kamoda ..... 101/153
6,272,987 B1 * 8/2001 Kamoda ..... 101/153
6,367,385 B2 * 4/2002 Komori ..... 101/484
6,378,429 B1 * 4/2002 Tomita et al. ..... 101/365
6,615,725 B2 * 9/2003 Kurata et al. ..... 101/483
6,615,728 B2 * 9/2003 Kurata et al. ..... 101/484

FOREIGN PATENT DOCUMENTS

| | | |
|---|---|---|
| EP | 0 983 852 | 3/2000 |
| EP | 1080891 A | 3/2001 |
| EP | 1 083 047 | 3/2001 |
| JP | 05147200 | 6/1993 |
| JP | 05-147200 A | 6/1993 |

* cited by examiner

*Primary Examiner*—Charles H. Nolan, Jr.
(74) *Attorney, Agent, or Firm*—Blakely Sokoloff Taylor & Zafman

(57) ABSTRACT

In an ink supply amount control method for a printing press, ink is supplied from the gap between a plurality of ink fountain keys and an ink fountain roller to an ink supply path in accordance with rotation of the ink fountain roller. The swing operation of an ink ductor roller is temporarily stopped. When the swing operation should intermittently be stopped, the operation of the ink fountain key or the ink fountain roller is controlled to control the ink supply amount to the ink ductor roller. Ink in a corrected amount is supplied to a printing plate attached to a plate cylinder through the ink supply path by the swing operation of the ink ductor roller. An ink supply amount control apparatus is also disclosed.

24 Claims, 25 Drawing Sheets

INK SUPPLY AMOUNT CONTROL METHOD AND APPARATUS FOR PRINTING PRESS

BACKGROUND OF THE INVENTION

The present invention relates to ink supply amount control for a printing press and, more particularly to an ink supply amount control method and apparatus which can suppress any density variation in a printing product with a small image area by intermittently stopping swing (ink feed operation) of an ink ductor roller.

Generally, the ink supply amount to a printing plate in a printing press is controlled by a gap amount between an ink fountain key and an ink fountain roller. FIG. 20 shows the main part of an ink supply apparatus (inker) provided in a printing unit for each color (ink color) in a rotary printing press. Referring to FIG. 20, an ink fountain 1 stores ink 2. An ink fountain roller 3 supplies the ink from the ink fountain 1 to the ink supply path. A plurality of ink fountain keys 4 (4-1 to **4-*n*) are juxtaposed in the axial direction of the ink fountain roller 3. An ink ductor roller 5 is arranged in the ink supply path to supply the ink from the ink fountain keys 4 to ink rollers 6. A printing plate 7 is attached to the outer surface of a plate cylinder 8. The ink is supplied from the ink rollers 6 including an ink distribution roller 6-1 and ink form rollers 6-2 to the printing plate 7**.

In a four-color rotary printing press shown in FIG. 21, a printing unit 9 for each color individually has the ink supply apparatus shown in FIG. 20.

In the printing press having the above arrangement, the ink in the ink fountain 1 is supplied to the ink fountain roller 3 through the gap between the ink fountain keys 4 and the ink fountain roller 3 as the ink fountain roller 3 rotates. When the ink ductor roller 5 swings, the ink supplied to the ink fountain roller 3 is transferred to the ink ductor roller 5. The ink transferred to the ink ductor roller 5 is transferred to the ink distribution roller 6-1. The ink 2 transferred to the ink roller 6-1 is distributed by the ink rollers 6 and then supplied to the printing plate 7 through the ink form rollers 6-2. The ink supplied to the printing plate 7 is printed on a printing paper sheet through a blanket cylinder (not shown).

The gap amount (opening ratio of the ink fountain keys 4-1 to **4-*n*) between the ink fountain keys 4-1 to 4-*n* and the ink fountain roller 3 is set in accordance with the image area ratio in each of areas of the printing plate 7, which correspond to the ink fountain keys 4-1 to 4-*n*, respectively. For example, the set values of the opening ratios of the ink fountain keys 4-1 to 4-*n* are obtained in accordance with a preset "image area ratio—ink fountain key opening ratio conversion curve", and the opening ratios of the ink fountain keys 4-1 to 4-*n* are adjusted. The value of the rotation amount (feed amount) of the ink fountain roller 3 is defined in advance. The opening ratios of the ink fountain keys 4-1 to 4-*n* and the feed amount of the ink fountain roller 3 are set for the printing unit 9** of each color.

In the ink supply apparatus in each printing unit 9, the ink ductor roller 5 reciprocally swings between the ink fountain roller 3 and the ink roller 6-1 to transfer the ink from the ink fountain roller 3 to the ink roller 6-1. The reciprocal operation (ink feed operation) is done by the same driving source as that of the printing press in synchronism with the rotation of the plate cylinder 8 (the rotation of the printing press), thereby obtaining a predetermined ink transfer amount. For example, the ink ductor roller 5 is reciprocally swung once by a driving cam that rotates once in synchronism with six revolutions of the plate cylinder 8.

Along with the recent increase in operation speed of printing presses, the balance between the ink supply amount to a printing paper sheet and the open/close of ink fountain keys becomes delicate. It is therefore difficult to stably supply ink. Especially, for a printing product with a low image area ratio (a printing product with a small image), ink in an excess amount is supplied into the ink supply apparatus, resulting in a density variation.

An ink feed apparatus disclosed in Japanese Patent Laid-Open No. 5-147200 (reference 1), the swing of the ink ductor roller is intermittently stopped to reduce the ink supply amount into the ink supply apparatus, thereby suppressing a density variation in a printing product with a small image. To intermittently stop the swing operation, for example, the number of revolutions of a rotary shaft that rotates coaxially with a driving cam that reciprocally swings the ink ductor roller is detected by a sensor. An air cylinder is actuated at a ratio corresponding to an integral ratio to the detected number of revolutions. With this operation, the ink ductor roller is forcibly pressed against (locked to) the ink roller side, thereby stopping the reciprocal operation of the ink ductor roller.

As described above, when the swing of the ink ductor roller is intermittently stopped, any excess ink supply to a portion (small image portion) having a low image area ratio can be suppressed. However, this may cause shortage of the ink supply amount to a portion (large/medium image portion) having a high image area ratio. To prevent this, the operator must adjust the opening ratio of each ink fountain key or the feed amount of the ink fountain roller while repeating test printing. This poses problems that the adjustment takes long time, the load on the operator increases, the printing materials are wasted, and the operation efficiency becomes low.

SUMMARY OF THE INVENTION

It is an object of the present invention to provide an ink supply amount control method and apparatus for a printing press, which can solve excess ink supply to a small image portion and a shortage of the ink supply amount to a large/medium image portion simultaneously and reduce the load on the operator.

In order to achieve the above object, according to the present invention, there is provided an ink supply amount control method for a printing press, comprising the steps of supplying ink from a gap between a plurality of ink fountain keys and an ink fountain roller to an ink supply path in accordance with rotation of the ink fountain roller, intermittently stopping a swing operation of an ink ductor roller which is arranged in the ink supply path and swings in synchronism with rotation of the printing press, when the swing operation of the ink ductor roller should intermittently be stopped, controlling an operation of at least one of the ink fountain key and the ink fountain roller to control an ink supply amount to the ink ductor roller, and supplying ink in a corrected amount to a printing plate attached to a plate cylinder through the ink supply path by the swing operation of the ink ductor roller.

DESCRIPTION OF THE PREFERRED EMBODIMENTS

Figure 20:
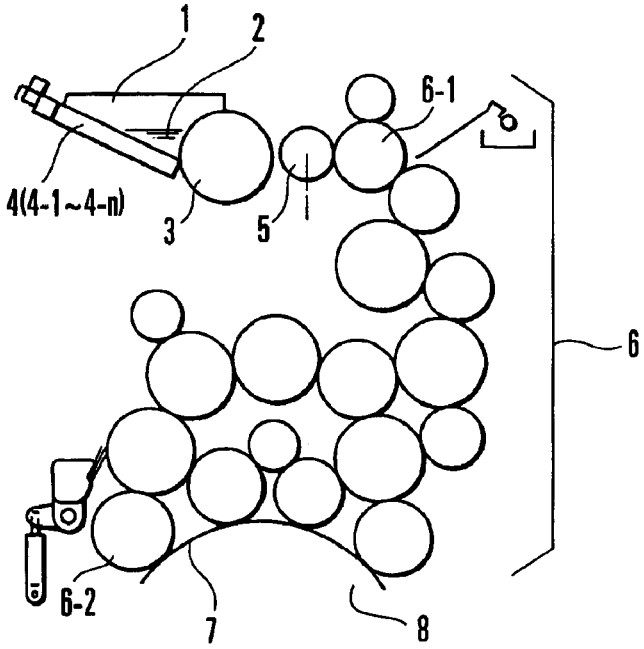
FIG. 20 is a view showing the main part of an ink supply apparatus provided in a printing unit for each color in a rotary printing press.

The present invention will be described below in detail with reference to the accompanying drawings. An ink supply apparatus and four-color rotary printing press have the same arrangements as in FIGS. 20 and 21, and a description thereof will be omitted.

[First Embodiment: Manual Method]

As the first embodiment, a method (manual method) of causing an operator to instruct at his/her own discretion to or not to perform "intermittent stop+correction" will be described.

Figure 1:
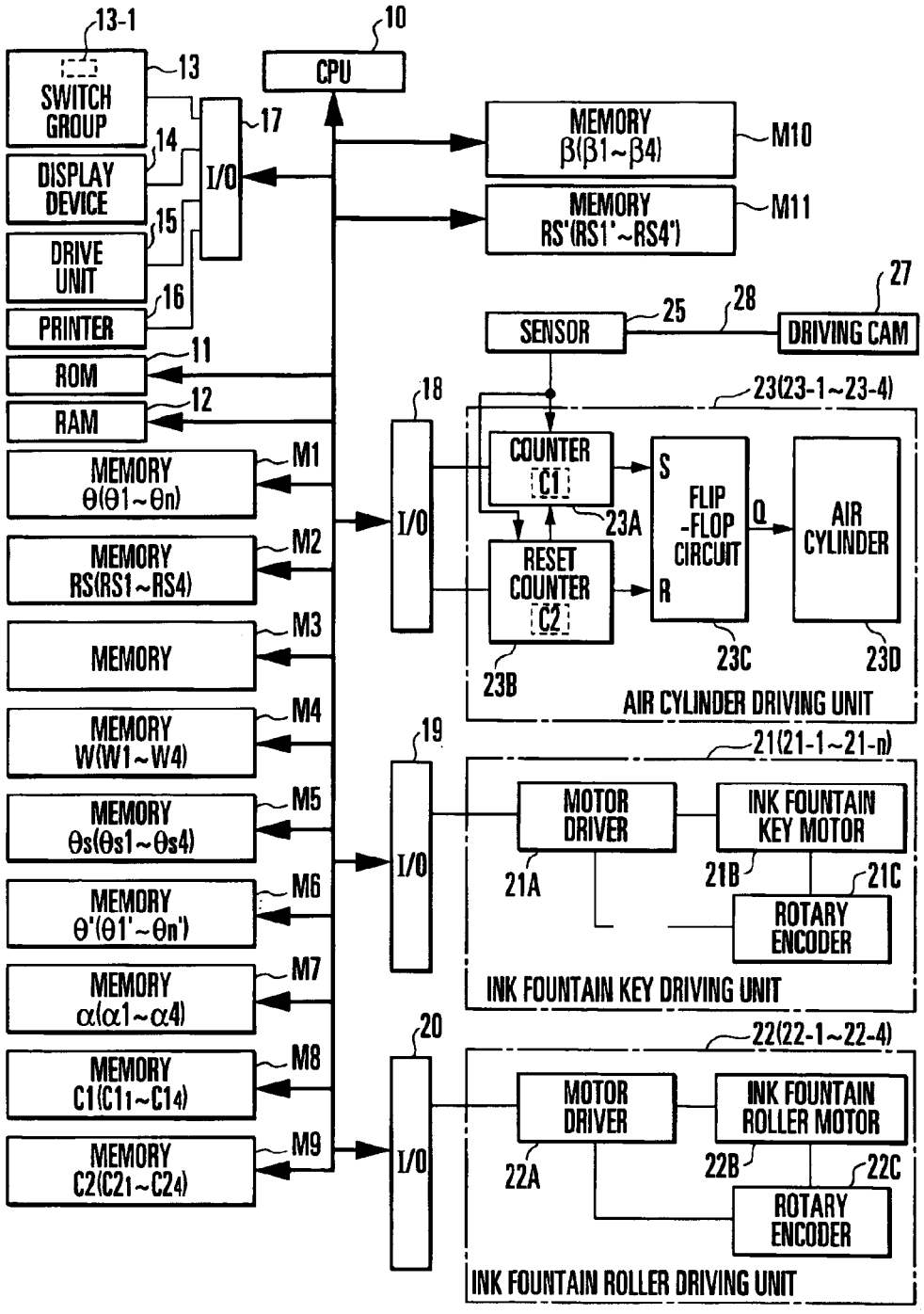
FIG. 1 is a block diagram of an ink supply amount control apparatus for a printing press according to the first embodiment of the present invention.

FIG. 1 shows an ink supply amount control apparatus for a printing press according to the first embodiment of the present invention. Referring to FIG. 1, reference numeral 10 denotes a CPU (Central Processing Unit); 11, a ROM (Read Only Memory); 12, a RAM (Random Access Memory); 13, a switch group including a correction button 13-1; 14, a display device; 15, a drive unit for a flexible disk or magnetic card; 16, a printer; and 17 to 20, input/output interfaces (I/O). Reference symbols M1 to M11 denote memories which stores various kinds of data. Reference numeral 21 denotes an ink fountain key driving unit; 22, an ink fountain roller driving unit; and 23, a feed stop air cylinder driving unit.

The CPU 10 obtains various kinds of input information that are supplied through the interface 17 and operates in accordance with a program stored in the ROM 11 while accessing the RAM 12. The ROM 11 stores a program (ink supply amount control program) which controls the ink supply amount to a printing plate 7 in a printing unit 9 of each color. This ink supply amount control program may be provided in the form of a recording medium such as a CD-ROM such that the program can be read out from the recording medium and installed in a hard disk (not shown).

The ink fountain key driving unit 21 is individually arranged in correspondence with each of ink fountain keys 4-1 to **4-*n* of each color. More specifically, one printing unit 9 has n ink fountain key driving units 21 (21-1 to 21-*n*) corresponding to n ink fountain keys 4 (4-1 to 4-*n*). These components are prepared in correspondence with each of the four printing units. The opening ratios of the ink fountain keys 4-1 to 4-*n* with respect to an ink fountain roller 3 are individually adjusted by the ink fountain key driving units 21-1 to 21-*n*. Each of the ink fountain key driving units 21-1 to 21-*n* comprises a motor driver 21A, an ink fountain key motor 21B which is driven by the motor driver 21A, and a rotary encoder 21C which detects the rotation state of the ink fountain key motor 21**B.

The ink fountain roller driving unit 22 is individually arranged in correspondence with each of the fountain rollers 3 of the respective colors. More specifically, the four-color rotary printing press has four ink fountain roller driving units 22-1 to 22-4 in correspondence with the four printing units 9. The feed amounts of the ink fountain rollers 3 of the respective colors are individually adjusted by the ink fountain roller driving units 22-1 to 22-4. Each of the ink fountain roller driving units 22-1 to 22-4 comprises a motor driver 22A, an ink fountain roller motor 22B which is driven by the motor driver 22A, and a rotary encoder 22C which detects the rotation state of the ink fountain roller motor 22B.

The feed stop air cylinder driving unit 23 is individually arranged in correspondence with each of ink ductor rollers 5 of the respective colors. More specifically, the four-color rotary printing press has four air cylinder driving units 23-1 to 23-4 in correspondence with the four printing units. The feed operations of the ink ductor rollers 5 of the respective colors are intermittently stopped by the air cylinder driving units 23-1 to 23-4.

Each of the air cylinder driving units 23-1 to 23-4 comprises a feed stop start counter 23A, a feed counter reset counter 23B, a flip-flop circuit 23C, and a feed stop air cylinder 23D. The counter 23A and reset counter 23B receive a 1-pulse signal from an ink feed cam rotation detection sensor 25 in correspondence with every revolution of a rotary shaft 28 that rotates coaxially with a driving cam 27 for reciprocally swinging the ink ductor roller 5. The mechanism that causes the driving cam 27 to reciprocally swing the ink ductor roller 5 is known, as indicated by reference 1. The contents described in reference 1 are incorporated in this specification.

Image data θ (θ1 to θn) of the printing plate 7 attached to a plate cylinder 8 in the printing unit 9 is written in the memory M1 in correspondence with each color. The image data θ is read out from, e.g., a recording medium set in the drive unit 15. Feed amount data RS (RS1 to RS4) of the ink fountain roller 3 of the printing unit 9 of each color is written in the memory M2. The feed amount data RS is read out from, e.g., a recording medium set in the drive unit 15. The "image area ratio—ink fountain key opening ratio conversion curve" of each color is stored in the memory M3.

A number W (W1 to W4) of times of stop of the feed operation of the ink ductor roller 5 in the printing unit 9 of each color is written in the memory M4. The number W of times of stop is set by the operator's key operation on the switch group 13. The "number of times of stop of the feed operation" represents the ratio of stop of the feed operation. In this embodiment, it means the number of times of or the ratio for thinning out the feed operations. For example, when the number W of times of stop is 1, the feed operation is stopped one cycle and then performed one cycle (although two cycles are required in fact, the feed operation is stopped one cycle). When the number W of times of stop is 2, the feed operation is stopped two cycles and then performed one cycle (although three cycles are required in fact, the feed operation is stopped two cycles).

A predetermined value that is used to determine whether the opening ratio of each ink fountain key in the printing unit 9 of each color corresponds to a small image portion is written in the memory M5 as a small image portion determination value θs (θs1 to θs4). The small image portion determination value θs is set by the operator's key operation on the switch group 13. An opening ratio correction value θ' (θ1' to θn') obtained by correcting an opening ratio set value θ (θ1 to θn) of each ink fountain key 4 in the printing unit 9 by processing to be described later is written in the memory M6 in correspondence with each color.

A correction coefficient α (α1 to α4) of the opening ratio of each ink fountain key 4 in the printing unit 9 of each color is written in the memory M7. The correction coefficient α is set by the operator's key operation on the switch group 13 as an arbitrary value that satisfies α>0. A set value C1 ($C1_1$ to $C1_4$) to be set in the counter 23A of the air cylinder driving unit 23 corresponding to the printing unit 9 of each color, which is obtained from the number W of times of stop, is written in the memory M8. The number W of times of stop is set by the operator's key operation.

A set value C2 ($C2_1$ to $C2_4$) to be set in the reset counter 23B of the air cylinder driving unit 23 in the printing unit 9 of each color, which is obtained from the number W of times of stop set by the operator's key operation, is written in the memory M9.

A correction coefficient β (β1 to β4) of the feed amount, which is set for the ink fountain roller 3 in the printing unit 9 of each color, is written in the memory M10. The correction coefficient β is set by the operator's key operation on the switch group 13 as an arbitrary value that satisfies β>0. A feed amount correction value RS' (RS1' to RS4') obtained by correcting the feed amount set value RS (RS1 to RS4) of the ink fountain roller 3 in the printing unit 9 of each color by processing to be described later is written in the memory M11.

OPERATION EXAMPLE 1

Intermittent Stop+Ink Fountain Key Opening Ratio Correction

The operation (operation example 1) of the ink supply amount control apparatus having the above arrangement before the start of printing will be described with reference to FIGS. 2A and 2B. The same operation is executed in all the printing units 9, and the operation in one printing unit 9 will be described here.

Before the operation starts, the "image area ratio—ink fountain key opening ratio conversion curve" of each color is stored in the memory M3 in advance. In addition, the small image portion determination value θs (θs1 to θs4) is stored in the memory M5, and the correction coefficient α (α1 to α4) of the opening ratio of each ink fountain key 4 is written in the memory M7 in advance by the operator's key operation on the switch group 13.

[Read and Storage of Image Data and Feed Amount Data]

The CPU 10 reads out the image data of the printing plate 7 attached to the plate cylinder 8 in the printing unit 9 and the feed amount data RS of the ink fountain roller 3 in the printing unit 9 from, e.g., a recording medium set in the drive unit 15. The readout image data is written in the memory M1 as an opening ratio set value of the ink fountain key 4. The feed amount data RS is written in the memory M2 as a feed amount set value of the ink fountain roller 3 (steps S101 and S102).

As the image data, image area ratio data S1 to Sn of each area of the printing plate 7 corresponding to the ink fountain roller driving units 22-1 to 22-4 in the printing unit 9 may be input. Alternatively, the ink fountain key opening ratio data θ1 to θn obtained by converting the image area ratio of each area of the printing plate 7 corresponding to the ink fountain key 4 into the opening ratio of the ink fountain key 4 may be input.

It is determined next whether the input image data is image area ratio data (step S103). If YES in step S103, the CPU 10 reads out the "image area ratio—ink fountain key opening ratio conversion curve" stored in the memory M3 (step S104). The CPU 10 converts the image area ratio data S1 to Sn into the ink fountain key opening ratios θ1 to θn by using the readout "image area ratio—ink fountain key opening ratio conversion curve" and stores the ink fountain key opening ratios θ1 to θn in the memory M1 again (step S105).

If NO in step S103, the CPU 10 immediately advances to step S106. Accordingly, the opening ratios θ1 to θn of the ink fountain keys 4 are written in the memory M1 as set values.

[Preparation for Intermittent Stop of Ink Feed Operation]

The CPU 10 determines the presence/absence of the input of the number W of times of stop of the ink ductor roller 5 in the printing unit 9 (step S106). When the number W of times of stop is input by the operator's key operation on the switch group 13, the input number W of times of stop is written in the memory M4 (step S107).

Next, the CPU 10 obtains, from the number W of times of stop, the set value C1 for the counter 23A in the air cylinder driving unit 23 and the set value C2 for the reset counter 23B and writes the set values C1 and C2 in the memories M8 and M9, respectively (step S108). The set value C1 is sent to the counter 23A, and the set value C2 is sent to the reset counter 23B and set (steps S109 and S110).

For example, when the number W of times of stop is 1, it is determined that although two cycles of feed operation are required in fact, the feed operation should be stopped one cycle. The set value C1 for the counter 23A is set to 1, and the set value C2 for the reset counter 23B is set to 2. When the set values C1 and C2 are set for the counter 23A and reset counter 23B, preparation for intermittent stop of the ink feed operation of the ink ductor roller 5 in the printing unit 9 is done. Actual printing may be executed at this time.

[Intermittent Stop of Ink Feed Operation]

Intermittent stop of the ink feed operation in the printing unit 9 will be described by exemplifying a case wherein the number W of times of stop is 1. When the operation of the printing press starts, a 1-pulse signal (sensor signal) is generated by the sensor 25 in correspondence with every revolution of the rotary shaft 28 that rotates coaxially with the driving cam 27 that reciprocally swings the ink ductor roller 5 in synchronism with the rotation of the printing press. The sensor signal from the sensor 25 is supplied to the counter 23A and reset counter 23B.

Upon counting the sensor signal C1 times (once in this example), the counter 23A outputs "H" level to the S input of the flip-flop circuit 23C to set the flip-flop circuit 23C and set the Q output to "H" level. In accordance with the Q output of "H" level from the flip-flop circuit 23C, the air cylinder 23D is actuated to press the ink ductor roller 5 to the side of an ink roller 6-1 so that the ink feed operation is stopped during this time. Even while the ink feed operation is stopped, the rotary shaft that rotates coaxially with the driving cam that reciprocally swings the ink ductor roller 5 continuously rotates. Hence, the input of the sensor signal to the counter 23A and reset counter 23B continues.

Upon counting the sensor signal C2 times (twice in this example), the reset counter 23B resets the flip-flop circuit 23C to set the Q output to "L" level. Accordingly, the air cylinder 23D is restored to the inactive state, and the ink feed operation is resumed. Upon counting the sensor signal C2 times, the reset counter 23B returns the count value of its own and the count value of the counter 23A to zero to prepare for the next sensor signal input. As described above, when the number W of times of stop is 1, the ink feed operation is stopped one cycle and then executed one cycle. In this way, the ink feed operation is intermittently stopped.

[Correction of Ink Fountain Key Opening Ratio]

The CPU 10 determines whether the correction button 13-1 of the switch group 13 is turned on (step S111). When the operator presses the correction button 13-1 at his/her own discretion before the start of printing or after checking the result of test printing, the CPU 10 corrects the opening ratio of each ink fountain key in the following way.

The CPU 10 reads out the first ink fountain key opening ratio set value θ1 from the memory M1 and the small image portion determination value θs from the memory M5 (steps S112 and S113). The CPU 10 compares the readout ink fountain key opening ratio set value θ1 with the small image portion determination value θs (step S114). If θ1<θs, the flow advances to step S115. If θ1≧θs, the flow advances to step S116.

If θ1<θs, the area of the printing plate 7, which corresponds to the ink fountain key 4, is determined as a small image portion. The ink fountain key opening ratio set value θ1 read out from the memory M1 is directly written in the memory M6 as θ1' (step S115).

If θ1≧θs, the area of the printing plate 7, which corresponds to the ink fountain key 4, is determined as a large/medium image portion. The correction coefficient α is read out from the memory M7 (step S116). The CPU 10 multiplies the ink fountain key opening ratio set value θ1 read out from the memory M1 by the readout correction coefficient α to obtain a correction amount for the set value θ1 (step S117). The CPU 10 adds the obtained correction amount to the set value θ1 to obtain an ink fountain key opening ratio correction value θ1' and writes it in the memory M6 (step S118). If the corresponding area is a large/medium image portion, the opening ratio set value θ1 of the ink fountain key 4 is corrected such that it increases by the product of the set value and the correction coefficient α.

The CPU 10 reads out the next ink fountain key opening ratio set value θ2 from the memory M1 and the small image portion determination value θs from the memory M5 (steps S119 and S120). The CPU 10 compares the ink fountain key opening ratio set value θ2 with the small image portion determination value θs (step S121). If θ2<θs, the set value θ2 is directly written in the memory M6 as θ2', as in step S115 (step S122). If θ2≧θs, as in steps S116 to S118, the correction coefficient α is read out from the memory M7 (step S123). The set value θ2 is multiplied by the correction coefficient α to obtain a correction amount (step S124). A value obtained by adding the resultant correction amount to the set value θ2 is written in the memory M6 as θ2' (step S125).

In the same way, the CPU 10 repeats the operation in steps S119 to S125 until the read of all ink fountain key opening ratio set values θ from the memory M1 is confirmed (step S126). With this operation, the opening ratio correction values θ1' to θn' of all ink fountain keys are stored in the memory M6.

The ink fountain key opening ratio correction values θ1' to θn' stored in the memory M6 are not actually corrected when the set value θ is smaller than the small image portion determination value θs. The opening ratio correction values θ1' to θn' are corrected when the set value θ is larger than the small image portion determination value θs. That is, the ink fountain key opening ratio set values θ1 to θn corresponding to the ink fountain keys 4 are not corrected when the corresponding area is a small image portion (θ<θs). Only for a large/medium image portion (θ≧θs), the set values θ1 to θn are corrected to larger values.

As described above, in operation example 1, it is determined on the basis of the ink fountain key opening ratio set value θ whether an area corresponding to each ink fountain key is a small image portion. Only for an area that does not correspond to a small image portion, the ink fountain key opening ratio set value θ is corrected.

When the ink fountain key opening ratio correction values θ1' to θn' are stored in the memory M6 in step S126, the CPU 10 reads out the ink fountain key opening ratio correction values θ1' to θn' from the memory M6 (step S127) and sends the readout ink fountain key opening ratio correction values θ1' to θn' to the motor driver 21A of the ink fountain key driving unit 21 (step S128). The ink fountain key motor 21B is driven to adjust the opening ratios of the ink fountain keys 4 in the printing unit 9 to the correction values θ1' to θn'.

Next, the CPU 10 reads out the ink fountain roller feed amount set value RS from the memory M2 (step S129) and sends the readout set value RS to the motor driver 22A of the ink fountain roller driving unit 22 (step S130). Accordingly, at the time of printing, the feed amount of the ink fountain roller 3 in the printing unit 9 is adjusted to the set value RS.

In operation example 1, the operator instructs at his/her own discretion to intermittently stop the ink feed operation and correct the ink fountain key opening ratio (i.e., the number W of times of stop is input, and the correction button 13-1 is turned on). Then, the set values C1 and C2 are set in the air cylinder driving unit 23 to prepare for intermittent stop of the ink feed operation. In addition, of the ink fountain key opening ratio set values θ1 to θn for the ink fountain keys 4, only the set values corresponding to large/medium image portions except small image portions are corrected to larger values.

As described above, when the opening ratio of each ink fountain key is corrected in accordance with the image area ratio, the ink supply amount to a large/medium image portion increases. Hence, the excess ink supply to a small image portion and a shortage of the ink supply amount to a large/medium image portion are simultaneously solved. Hence, the operator need not adjust the opening ratio of each ink fountain key or the feed amount of the ink fountain roller while repeating test printing. Accordingly, the problems that the adjustment takes long time, the load on the operator increases, the printing materials are wasted, and the operation efficiency becomes low can be solved.

OPERATION EXAMPLE 2

Intermittent Stop+Ink Fountain Roller Feed Amount Correction

In operation example 1 described above, when the ink feed operation should intermittently be stopped, the ink fountain key opening ratio set values θ1 to θn are corrected in accordance with the image area ratio. In place of the ink fountain key opening ratio set values θ1 to θn, the set value RS of the feed amount of the ink fountain roller 3 may be corrected in accordance with the image area ratio.

In operation example 2 to be described below, the set value RS of the feed amount of the ink fountain roller 3 is corrected in correspondence with a large/medium image portion. With this operation, the ink supply amount to the large/medium image portion that requires a higher ink fountain key opening ratio is increased as compared to a small image portion that requires a low ink fountain key opening ratio.

Figure 3:
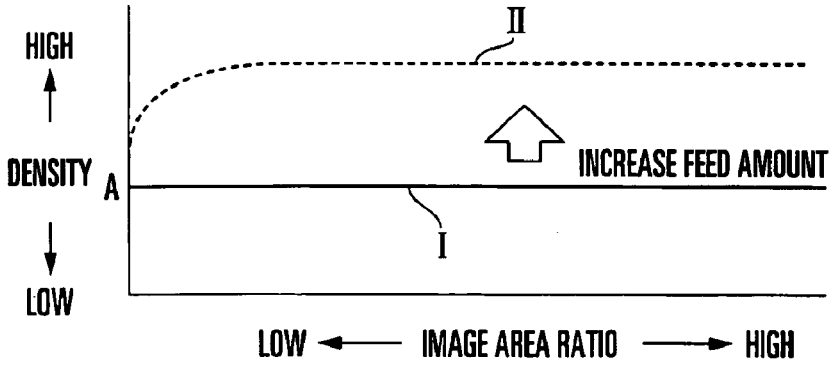
FIG. 3 is a graph showing the relationship between the image area ratio and the printing density when the ink fountain roller feed amount is adjusted.

When the ink fountain roller feed amount is adjusted, the image area ratio (abscissa) vs. printing density (ordinate) characteristic changes as shown in FIG. 3. A characteristic I indicates a state wherein the printing density has a predetermined value A independently of the image area ratio. When the ink fountain roller feed amount is increased, the density value increases. In this case, as indicated by a characteristic II, the increase in printing density value with respect to the increase in ink fountain roller feed amount is small at a portion having a low image area ratio. As the image area ratio becomes high, the printing density value gradually increases. When the image area ratio reaches a certain value, the printing density value becomes almost constant. As is apparent from this fact, when the ink fountain roller feed amount is increased, the ink supply amount to a large/medium image portion more largely increases as compared to the increase in ink supply amount to a small image portion.

Figure 4:
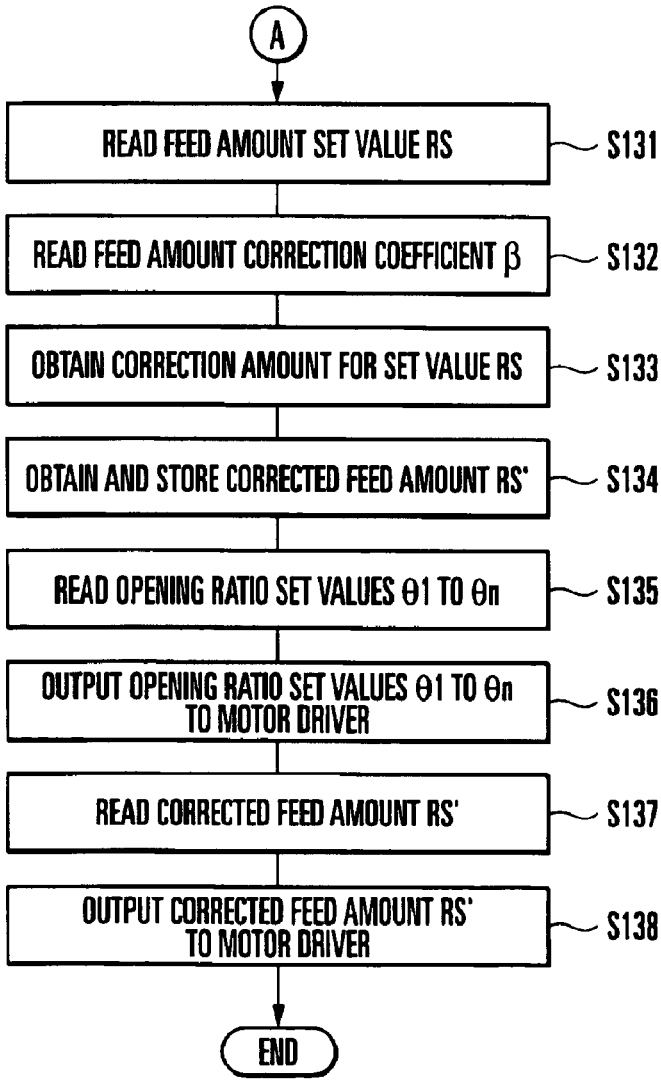
FIG. 4 is a flow chart for explaining the operation (operation example 2) of the ink supply amount control apparatus shown in FIG. 1 before the start of printing.

The operation procedures in operation example 2 will be described next with reference to FIG. 4. The flow chart shown in FIG. 4 explains operation procedures following step S111 in FIG. 2A. The operation until step S111 is the same as in operation example 1, and a description thereof will be omitted. Before the operation starts, the feed amount correction coefficient β (β1 to β4) for the ink fountain roller 3 in the printing unit 9 of each color is written in the memory M10 by the operator's key operation on the switch group 13.

Figure 2A:
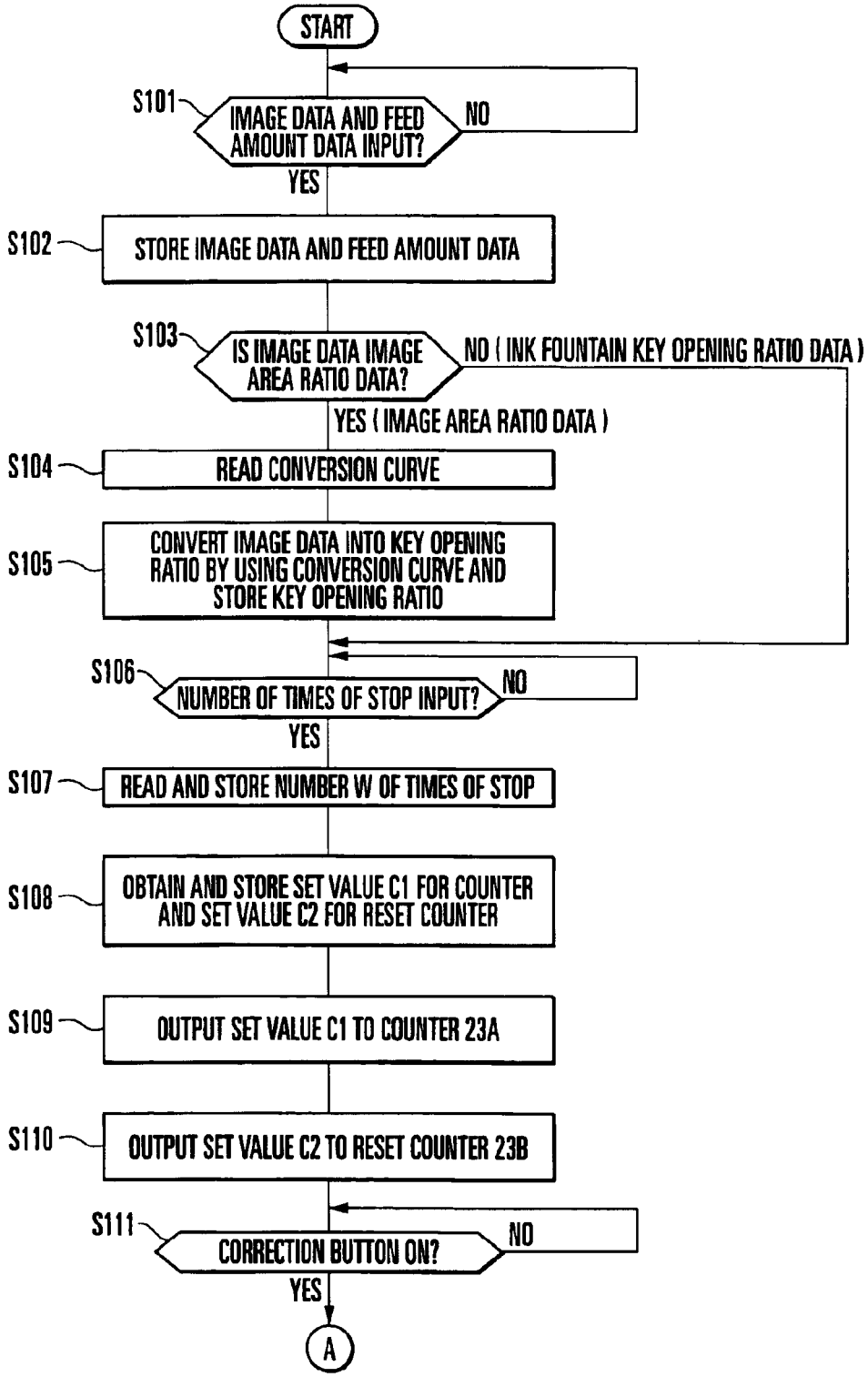
FIGS. 2A and 2B are flow charts for explaining the operation (operation example 1) of the ink supply amount control apparatus shown in FIG. 1 before the start of printing.
Figure 2B:
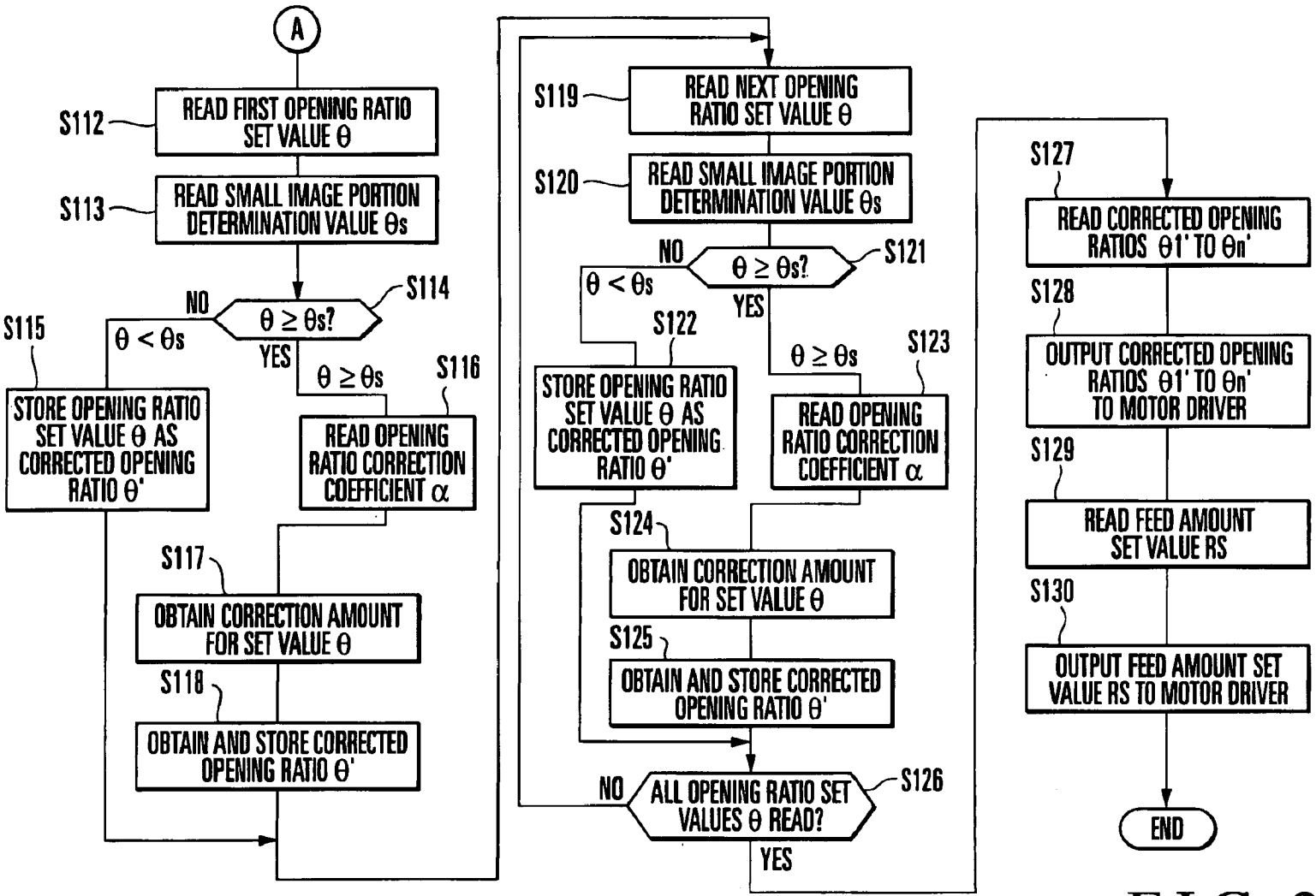

When the printing product has a small image, the operator presses the correction button 13-1 in step S111 in FIG. 2A so that the CPU 10 reads out the ink fountain roller feed amount set value RS from the memory M2 (step S131). The CPU 10 reads out the correction coefficient β from the memory M10 (step S132). The ink fountain roller feed amount set value RS read out from the memory M2 is multiplied by the readout correction coefficient β to obtain the correction amount for the set value RS (step S133).

Next, the CPU 10 adds the obtained correction amount to the ink fountain roller feed amount set value RS read out from the memory M2 to obtain the ink fountain roller feed amount correction value RS' (RS'=(1+β)·RS) and writes it in the memory M11 (step S134). Accordingly, the feed amount set value RS for the ink fountain roller 3 is corrected to be larger by the product of the set value RS and the correction coefficient β.

The CPU 10 reads out the ink fountain key opening ratio set values θ1 to θn from the memory M1 (step S135) and sends the readout ink fountain key opening ratio set values θ1 to θn to the motor driver 21A of the ink fountain key driving unit 21 (step S136). Accordingly, the ink fountain key motor 21B is driven to adjust the opening ratios of the ink fountain keys 4 in the printing unit 9 to the set values θ1 to θn.

The CPU 10 reads out the ink fountain roller feed amount correction value RS' from the memory M11 (step S137) and sends the readout ink fountain roller feed amount correction value RS' to the ink fountain roller motor driver 22A of the ink fountain roller driving unit 22 (step S138). Accordingly, at the time of printing, the feed amount of the ink fountain roller 3 in the printing unit 9 is adjusted to the correction value RS'.

In operation example 2, when the operator instructs intermittent stop of the ink feed operation and ink fountain roller feed amount correction at his/her own discretion, the set values C1 and C2 are automatically set in the air cylinder driving unit 23 to prepare for intermittent stop of the ink feed operation. At this time, correction is done such that the feed amount set value RS for the ink fountain roller 3 becomes large.

As described above, when the feed amount set value RS for the ink fountain roller 3 is corrected in accordance with the image area ratio, the ink supply amount to a large/medium image portion increases more than that to a small image portion. For this reason, the excess ink supply to a small image portion and a shortage of the ink supply amount to a large/medium image portion are simultaneously solved. Hence, the operator need not adjust the opening ratio of each ink fountain key or the feed amount of the ink fountain roller while repeating test printing. Accordingly, the problems that the adjustment takes long time, the load on the operator increases, the printing materials are wasted, and the operation efficiency becomes low can be solved.

[Second Embodiment: Automatic Method ①]

As the second embodiment, a first method (automatic method ①) of automatically performing "intermittent stop+correction" in accordance with the determination of a CPU 10 will be described.

The second embodiment shown in FIG. 5 further comprises a small image portion counter memory M12, small image portion count determination value memory M13, and small image portion counter 24 (to be described later), in addition to the arrangement of the first embodiment. A switch group 13 includes an automatic setting switch 13-2.

OPERATION EXAMPLE 1

Intermittent Stop+Ink Fountain Key Opening Ratio Correction

A characteristic operation (operation example 1) of the ink supply amount control apparatus before the start of printing will be described with reference to FIGS. 7, 6A, and 6B. The same operation is executed in all printing units 9, and the operation in one printing unit 9 will be described here.

Before the operation starts, the "image area ratio—ink fountain key opening ratio conversion curve" of each color is stored in a memory M3. In addition, various data are stored in the memories. More specifically, a number W of times of stop (W1 to W4) of feed operation for an ink fountain roller 3 in the printing unit 9 of each color is written in a memory M4. A small image portion determination value θs (θs1 to θ s4) for an ink fountain key 4 in the printing unit 9 of each color is written in a memory M5. A correction coefficient α (α1 to α4) of the opening ratio of each ink fountain key 4 in the printing unit 9 of each color is written in a memory M7. The number of small image portions of each color, which is to be used to determine whether intermittent stop of the ink feed operation should be executed, is written in the memory M13 as a small image portion count determination value Ks (Ks1 to Ks4).

[Read and Storage of Image Data and Feed Amount Data]

In the ink supply amount control apparatus according to this embodiment as well, the ink fountain key opening ratio is set first in the following way.

The CPU 10 reads out the image data of a printing plate 7 attached to a plate cylinder 8 in the printing unit 9 and feed amount data RS of an ink fountain roller 3 in the printing unit 9 from, e.g., a recording medium set in a drive unit 15. The image data is written in a memory M1 as an opening ratio set value of the ink fountain key 4 (step S201). The feed amount data RS is written in a memory M2 as a feed amount set value of the ink fountain roller 3 (step S202).

The CPU 10 determines whether the input image data is image area ratio data (step S203). If YES in step S203, the CPU 10 reads out the "image area ratio—ink fountain key opening ratio conversion curve" for the printing unit 9, which is stored in the memory M3 (step S204). The CPU 10 converts image area ratio data S1 to Sn into the ink fountain key opening ratios θ1 to θn by using the readout "image area ratio—ink fountain key opening ratio conversion curve" and stores the ink fountain key opening ratios θ1 to θn in the memory M1 again (step S205).

If NO in step S203, the CPU 10 immediately advances to step S206. Accordingly, the opening ratios θ1 to θn of the ink fountain keys 4 are written in the memory M1 as set values.

[Determination of Necessity of Intermittent Stop of Ink Feed Operation]

It is subsequently determined in the following manner whether intermittent stop of the ink feed operation should be executed. It is determined whether the operator has pressed the automatic setting switch 13-2 of the switch group 13 (step S206). When the automatic setting switch 13-2 is turned on, the CPU 10 resets the count value of the small image portion counter 24 to zero (step S207).

The CPU 10 reads out the first ink fountain key opening ratio set value θ1 from the memory M1 and the small image portion determination value θs from the memory M5 (steps S208 and S209). The CPU 10 compares the ink fountain key opening ratio set value θ1 with the small image portion determination value θs (step S210). If θ1<θs, the count value of the small image portion counter 24 is incremented by one (step S211). If θ1≧θs, the flow immediately advances to step S212.

More specifically, if θ1<θs, the area of the printing plate 7, which corresponds to an ink fountain key 4-1, is determined as a small image portion. The count value of the small image portion counter 24 is incremented by one. If θ1≧θs, the area of the printing plate 7, which corresponds to the ink fountain key 4-1, is determined as a large/medium image portion. The flow immediately advances to step S212 without incrementing the count value of the small image portion counter 24.

The CPU 10 reads out the next ink fountain key opening ratio set value θ2 from the memory M1 and the small image portion determination value θs from the memory M5 (steps S212 and S213). The CPU 10 compares the ink fountain key opening ratio set value θ2 with the small image portion determination value θs (step S214). If θ2<θs, the area is determined as a small image portion, as in step S211, and the count value of the small image portion counter 24 is incremented by one (step S215). If θ2≧θs, the area is determined as a large/medium image portion, and the flow immediately advances to step S216.

In the same way, the CPU 10 repeats the operation in steps S212 to S215 until the read of all ink fountain key opening ratio set values θ from the memory M1 is confirmed (step S216). With this operation, the counter 24 counts the number of ink fountain keys (the number of small image portions), of all the ink fountain keys 4, which are determined as small image portions because the opening ratio set values θ are smaller than θs.

The CPU 10 writes a number Km of small image portions counted by the counter 24 in the memory M12 (step S217), reads out the small image portion count determination value Ks from the memory M13 (step S218), and compares the number Km of small image portions with the small image portion count determination value Ks (step S219).

If Km≦Ks, the CPU 10 determines that the printing plate 7 set on the plate cylinder 8 in the printing unit 9 has a small number of small image portions, and intermittent stop of the ink feed operation is unnecessary.

In this case, the CPU 10 reads out the ink fountain key opening ratio set values θ1 to θn from the memory M1 (step S220), sends the readout ink fountain key opening ratio set values θ1 to θn to a motor driver 21A of an ink fountain key driving unit 21 (step S221), and adjusts the opening ratios of the ink fountain keys 4 to the set values θ1 to θn.

Next, the CPU 10 reads out the ink fountain roller feed amount set value RS from the memory M2 (step S222), sends the readout ink fountain roller feed amount set value RS to a motor driver 22A of an ink fountain roller driving unit 22 (step S223), and adjusts the feed amount of the ink fountain roller 3 at the time of printing to the set value RS.

In the above way, when the CPU 10 determines that the number of small image portions is small, the opening ratios of the ink fountain keys 4 are adjusted to the normal set values θ1 to θn. In addition, the feed amount of the ink fountain roller 3 at the time of printing is adjusted to the normal set value RS. The series of processing operations are thus ended.

To the contrary, if Km>Ks, the CPU 10 determines that the printing plate 7 set on the plate cylinder 8 in the printing unit 9 has a large number of small image portions, and intermittent stop of the ink feed operation is necessary.

In this case, the CPU 10 reads out the number W of times of stop from the memory M4 (step S224). A set value C1 for a counter 23A in an air cylinder driving unit 23 and a set value C2 for a reset counter 23B are obtained from the number W of times of stop and written in memories M8 and M9 (step S225). The set value C1 is set in the counter 23A, and the set value C2 is set in the reset counter 23B (steps S226 and S227).

[Correction of Ink Fountain Key Opening Ratio]

The CPU 10 reads out the first ink fountain key opening ratio set value θ1 from the memory M1 and the small image portion determination value θs from the memory M5 (steps S228 and S229). The CPU 10 compares the readout ink fountain key opening ratio set value θ1 with the small image portion determination value θs (step S230). If θ1<θs, the flow advances to step S231. If θ1≧θs, the flow advances to step S232.

More specifically, if θ1<θs, the CPU 10 determines that the area of the printing plate 7, which corresponds to the ink fountain key 4-1, is a small image portion. The ink fountain key opening ratio set value θ1 read out from the memory M1 is directly written in a memory M6 as θ1' (step S231).

If θ1≧θs, the CPU 10 determines that the area of the printing plate 7, which corresponds to the ink fountain key 4-1, is a large/medium image portion. In this case, the CPU 10 reads out the correction coefficient α from the memory M7 (step S232). The CPU 10 multiplies the ink fountain key opening ratio set value θ1 read out from the memory M1 by the correction coefficient α to obtain a correction amount for the set value θ1 (step S233).

The CPU 10 adds the correction amount to the set value θ1 to obtain an ink fountain key opening ratio correction value θ1' and writes it in the memory M6 (step S234). Accordingly, the opening ratio set value θ1 of the ink fountain key 4-1 whose corresponding area is determined as a large/medium image portion is corrected such that it increases by the product of the set value and the correction coefficient α.

The CPU 10 reads out the next ink fountain key opening ratio set value θ2 from the memory M1 and the small image portion determination value θs from the memory M5 (steps S235 and S236). The CPU 10 compares the ink fountain key opening ratio set value θ2 with the small image portion determination value θs (step S237). If θ2<θs, the set value θ2 is directly written in the memory M6 as θ2', as in step S231 (step S238).

If θ2≧θs, as in steps S232 to S234, the correction coefficient α is read out from the memory M7 (step S239). The set value θ2 is multiplied by the correction coefficient α to obtain a correction amount (step S240). A value obtained by adding the correction amount to the set value θ2 is written in the memory M6 as θ2' (step S241).

In the same way, the CPU 10 repeats the operation in steps S235 to S241 until the read of all ink fountain key opening ratio set values θ from the memory M1 is confirmed (step S242). With this operation, the opening ratio correction values θ1' to θn' of ink fountain keys are stored in the memory M6.

The ink fountain key opening ratio correction values θ1' to θn' stored in the memory M6 are not actually corrected when the set value θ is smaller than the small image portion determination value θs. The opening ratio correction values θ1' to θn' are corrected when the set value θ is larger than the small image portion determination value θs. That is, the ink fountain key opening ratio set values θ1 to θn corresponding to the ink fountain keys 4 are not corrected when the corresponding area is a small image portion (θ<θs). Only for a large/medium image portion (θ≧θs), the set values θ1 to θn are corrected to larger values.

As described above, in operation example 1, it is determined on the basis of the ink fountain key opening ratio set value θ whether an area corresponding to each ink fountain key is a small image portion. Only for an area that does not correspond to a small image portion, the ink fountain key opening ratio is corrected.

It is determined next whether storage of the ink fountain key opening ratio correction values θ1' to θn' in the memory M6 is ended (step S242). If YES in step S242, the CPU 10 reads out the ink fountain key opening ratio correction values θ1' to θn' from the memory M6 (step S243) and sends the readout ink fountain key opening ratio correction values θ1' to θn' to the motor driver 21A of the ink fountain key driving unit 21 (step S244). The ink fountain key motor 21B is driven to adjust the opening ratios of the ink fountain keys 4 in the printing unit 9 to the correction values θ1' to θn'.

Next, the CPU 10 reads out the ink fountain roller feed amount set value RS from the memory M2 (step S245) and sends the readout ink fountain roller feed amount set value RS to the motor driver 22A of the ink fountain roller driving unit 22 (step S246). Accordingly, at the time of printing, the feed amount of the ink fountain roller 3 in the printing unit 9 is adjusted to the set value RS.

In operation example 1, whether intermittent stop of the ink feed operation is to be executed is determined on the basis of the number of small image portions. The CPU 10 instructs intermittent stop of the ink feed operation on the basis of this determination. In accordance with this instruction, of the ink fountain key opening ratio set values θ1 to θn for the ink fountain keys 4, only the set values corresponding to large/medium image portions except small image portions are corrected to larger values. Since the ink supply amount to a large/medium image portion increases, the excess ink supply to a small image portion and a shortage of the ink supply amount to a large/medium image portion are simultaneously solved.

OPERATION EXAMPLE 2

Intermittent Stop+Ink Fountain Roller Feed Amount Correction

In operation example 1 described above, when the ink feed operation should intermittently be stopped, the ink fountain key opening ratio set values θ1 to θn are corrected in accordance with the image area ratio. In place of the ink fountain key opening ratio set values θ1 to θn, the set value RS of the feed amount of the ink fountain roller 3 may be corrected in accordance with the image area ratio.

In operation example 2 to be described below, the set value RS of the feed amount of the ink fountain roller 3 is corrected to a larger value. With this operation, the ink supply amount to a large/medium image portion that requires a higher ink fountain key opening ratio is increased as compared to a small image portion that requires a low ink fountain key opening ratio.

The operation procedures in operation example 2 will be described next with reference to FIG. 7. The flow chart shown in FIG. 7 follows processing that is executed after NO in step S219 in the flow chart in FIG. 6A. The operation until step S219 is the same as in operation example 1, and a description thereof will be omitted. Before the operation starts, a feed amount correction coefficient β (β1 to β4) for the ink fountain roller 3 in the printing unit 9 of each color is written in a memory M10 by the operator's key operation on the switch group 13.

If Km>Ks in step S219, the CPU 10 determines that the printing plate 7 set on the plate cylinder 8 in a printing unit 9-1 has a large number of small image portions, and intermittent stop of the ink feed operation is necessary.

Next, the CPU 10 reads out the number W of times of stop from the memory M4 (step S247). The set value C1 for the counter 23A in the feed stop air cylinder driving unit 23 and the set value C2 for the reset counter 23B are obtained from the number W of times of stop and written in the memories M8 and M9 (step S248). The set value C1 is sent to and set in the counter 23A, and the set value C2 is sent to and set in the reset counter 23B (steps S249 and S250).

The CPU 10 reads out the ink fountain roller feed amount set value RS from the memory M2 (step S251). The CPU 10 also reads out the correction coefficient β from the memory M10 (step S252). The ink fountain roller feed amount set value RS read out from the memory M2 is multiplied by the correction coefficient β to obtain the correction amount for the set value RS (step S253). Next, the CPU 10 adds the correction amount to the ink fountain roller feed amount set value RS read out from the memory M2 to obtain the ink fountain roller feed amount correction value RS' and writes it in a memory M11 (step S254). Accordingly, the feed amount set value RS for the ink fountain roller 3 is corrected to be larger by the product of the set value RS and the correction coefficient β.

The CPU 10 reads out the ink fountain key opening ratio set values θ1 to θn from the memory M1 (step S255) and sends the readout ink fountain key opening ratio set values θ1 to θn to the ink fountain key motor driver 21A of the ink fountain key driving unit 21 (step S256). Accordingly, the ink fountain key motor 21B is driven to adjust the opening ratios of the ink fountain keys 4 in the printing unit 9 to the set values θ1 to θn.

The CPU 10 reads out the ink fountain roller feed amount correction value RS' from the memory M11 (step S257) and sends the readout ink fountain roller feed amount correction value RS' to the ink fountain roller motor driver 22A of the ink fountain roller driving unit 22 (step S258). Accordingly, at the time of printing, the feed amount of the ink fountain roller 3 in the printing unit 9 is adjusted to the correction value RS'.

In operation example 2, whether intermittent stop of the ink feed operation is to be executed is determined on the basis of the number of small image portions. The CPU 10 instructs intermittent stop of the ink feed operation on the basis of this determination. In accordance with this instruction, the feed amount set value RS for the ink fountain roller 3 is corrected to a larger value. Since the ink supply amount to a large/medium image portion increases more than that to a small image portion, the excess ink supply to a small image portion and a shortage of the ink supply amount to a large/medium image portion are simultaneously solved.

[Third Embodiment: Automatic Method ②]

As the third embodiment, a second method (automatic method ②) of automatically performing "intermittent stop+correction" in accordance with the determination of a CPU 10 will be described with reference to FIG. 8.

Figure 5:
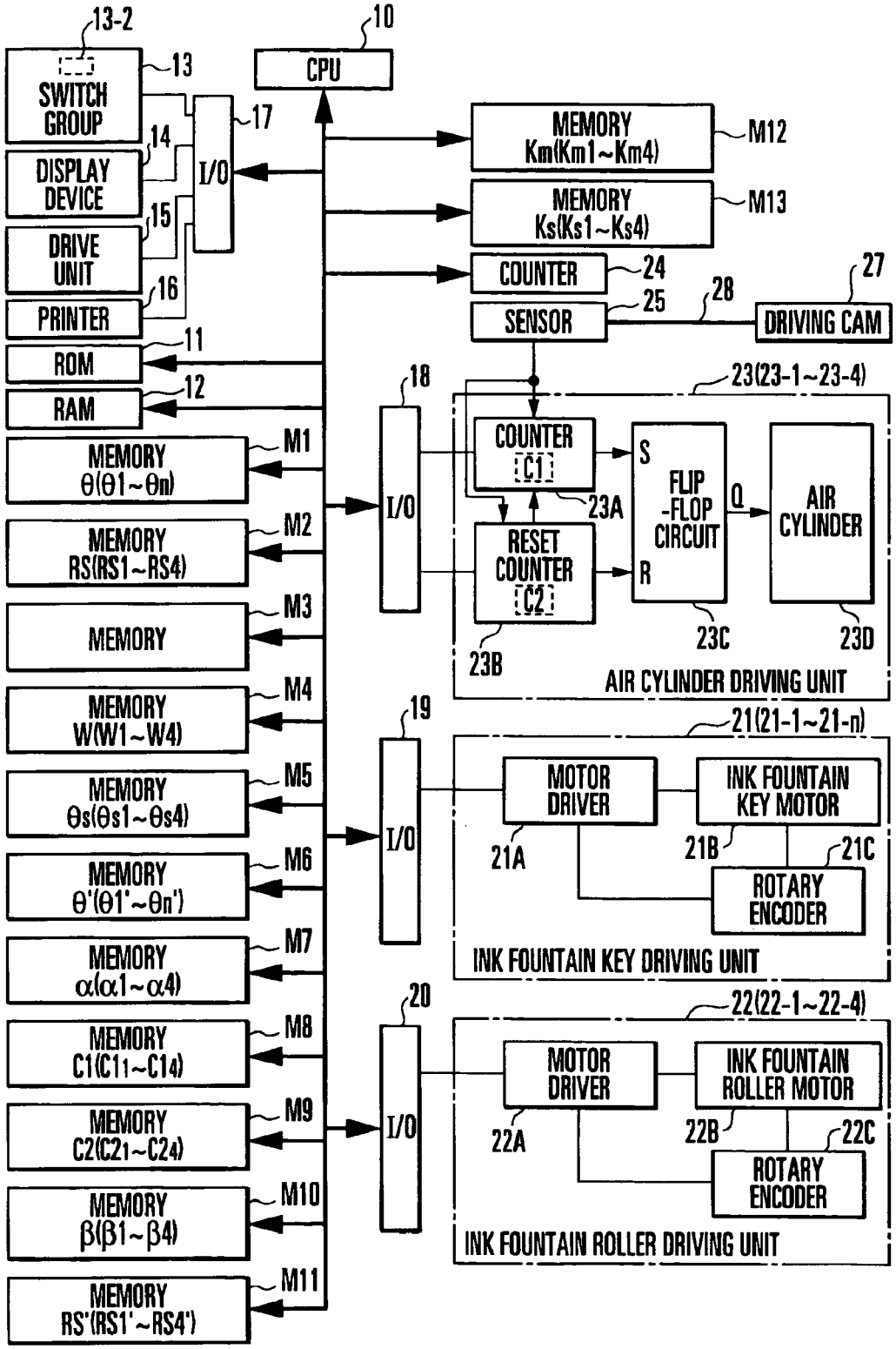
FIG. 5 is a block diagram of an ink supply amount control apparatus for a printing press according to the second embodiment of the present invention.
Figure 8:
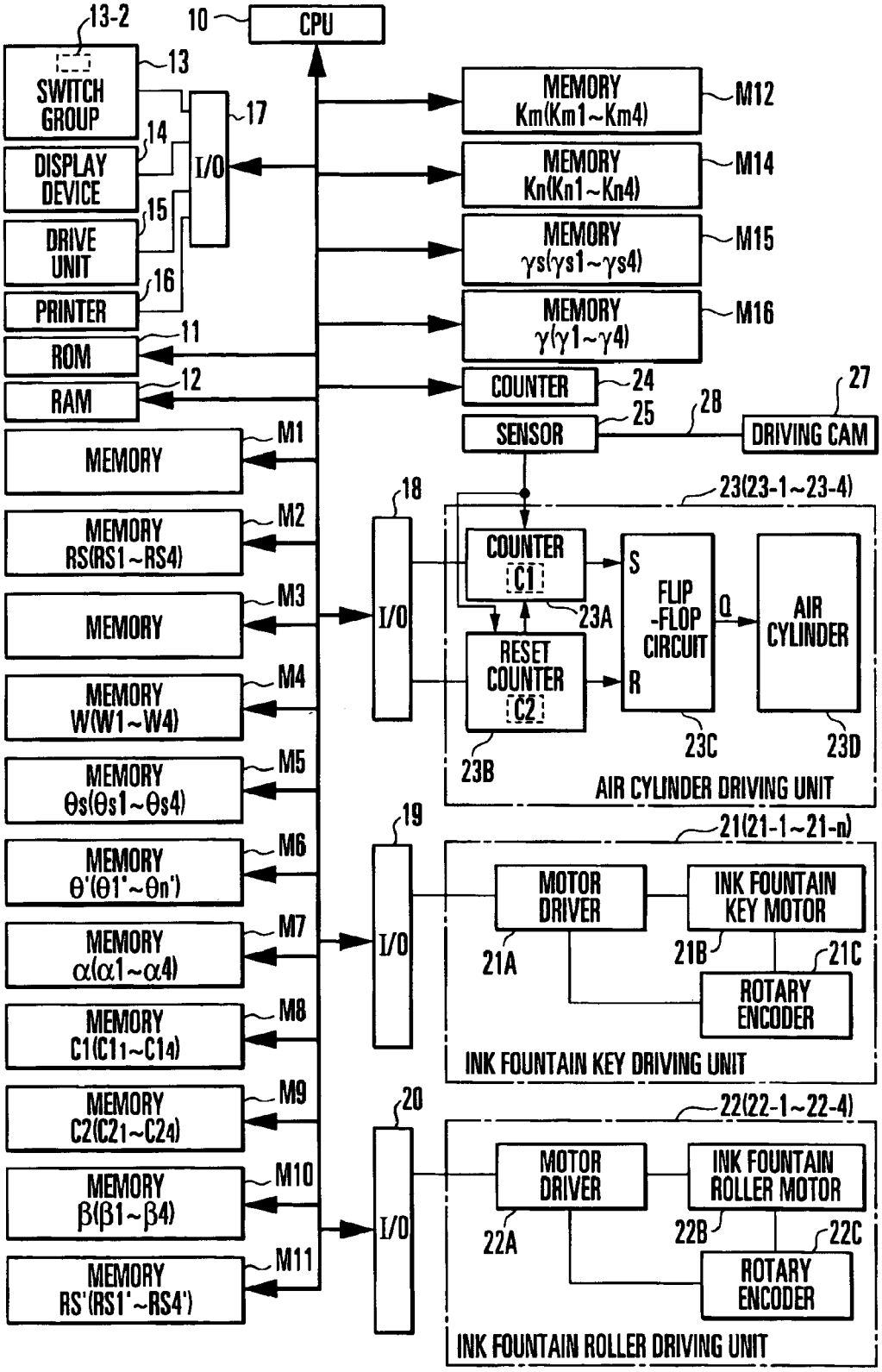
FIG. 8 is a block diagram of an ink supply amount control apparatus for a printing press according to the third embodiment of the present invention.

The same reference numerals as in FIG. 5 denote the same or similar constituent elements in FIG. 8, and a description thereof will be omitted. In the third embodiment, in place of the small image portion determination value memory M13 of the second embodiment, a memory M14 which stores the total number of ink fountain keys in each printing unit, a memory M15 which stores a determination value for the ratio of small image portions to the total number of ink fountain keys in each printing unit, and a memory M16 which stores the ratio of small image portions to the total number of ink fountain keys in each printing unit are arranged.

OPERATION EXAMPLE 1

Intermittent Stop+Ink Fountain Key Opening Ratio Correction

A characteristic operation (operation example 1) of the ink supply amount control apparatus before the start of printing will be described with reference to FIGS. 9A and 9B. The same operation is executed in all printing units 9, and the operation in one printing unit 9 will be described here.

In this embodiment, a total number Kn (Kn1 to Kn4) of ink fountain keys in the printing unit 9 of each color is written in the memory M14 in advance. A ratio (small image portion ratio determination value) γs (γs1 to γs4) of small image portions of each color, which is to be used to determine whether intermittent stop of the ink feed operation should be executed, is written in the memory M15 in advance.

Figure 6A:
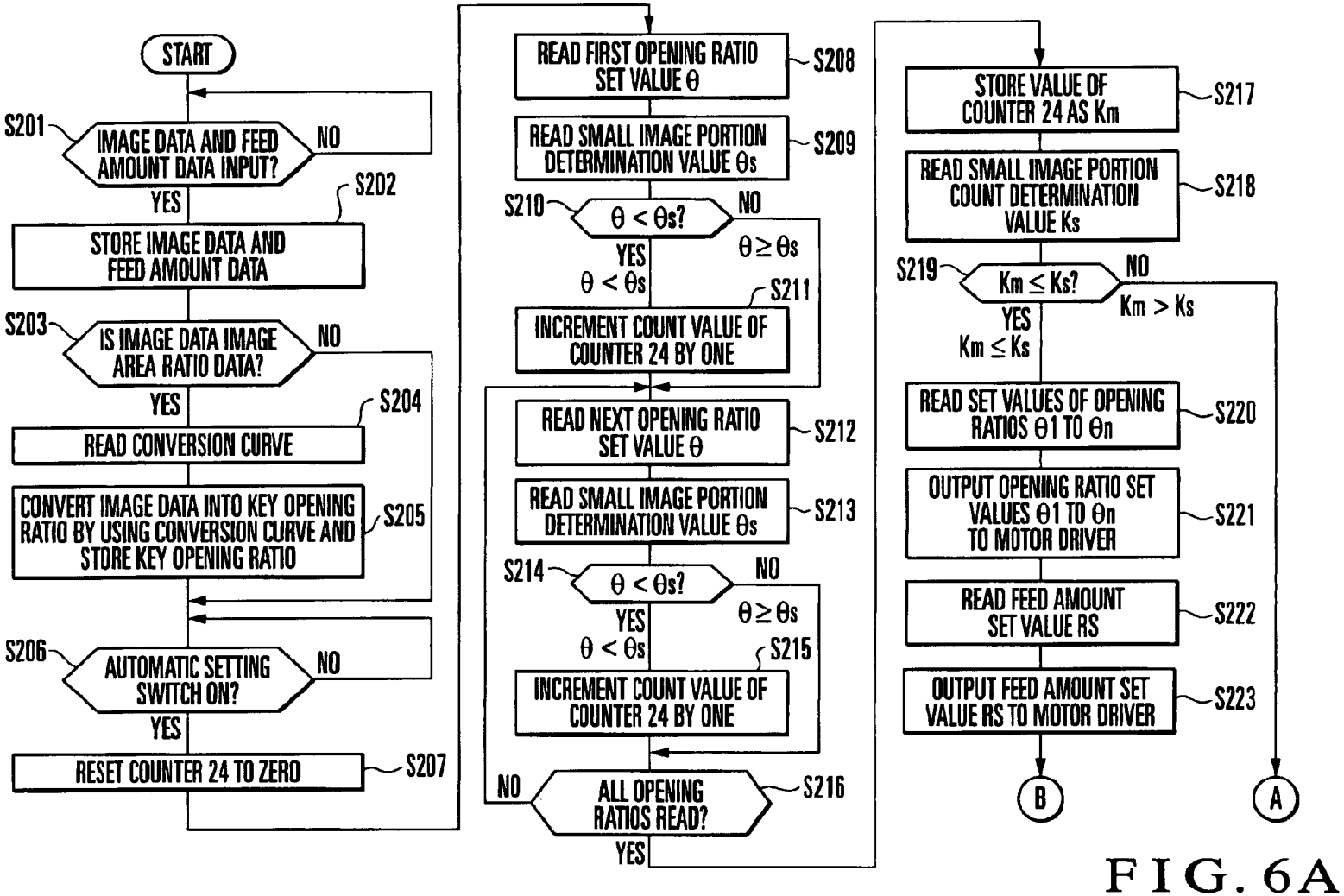
FIGS. 6A and 6B are flow charts for explaining the operation (operation example 1) of the ink supply amount control apparatus shown in FIG. 5 before the start of printing.
Figure 6B:
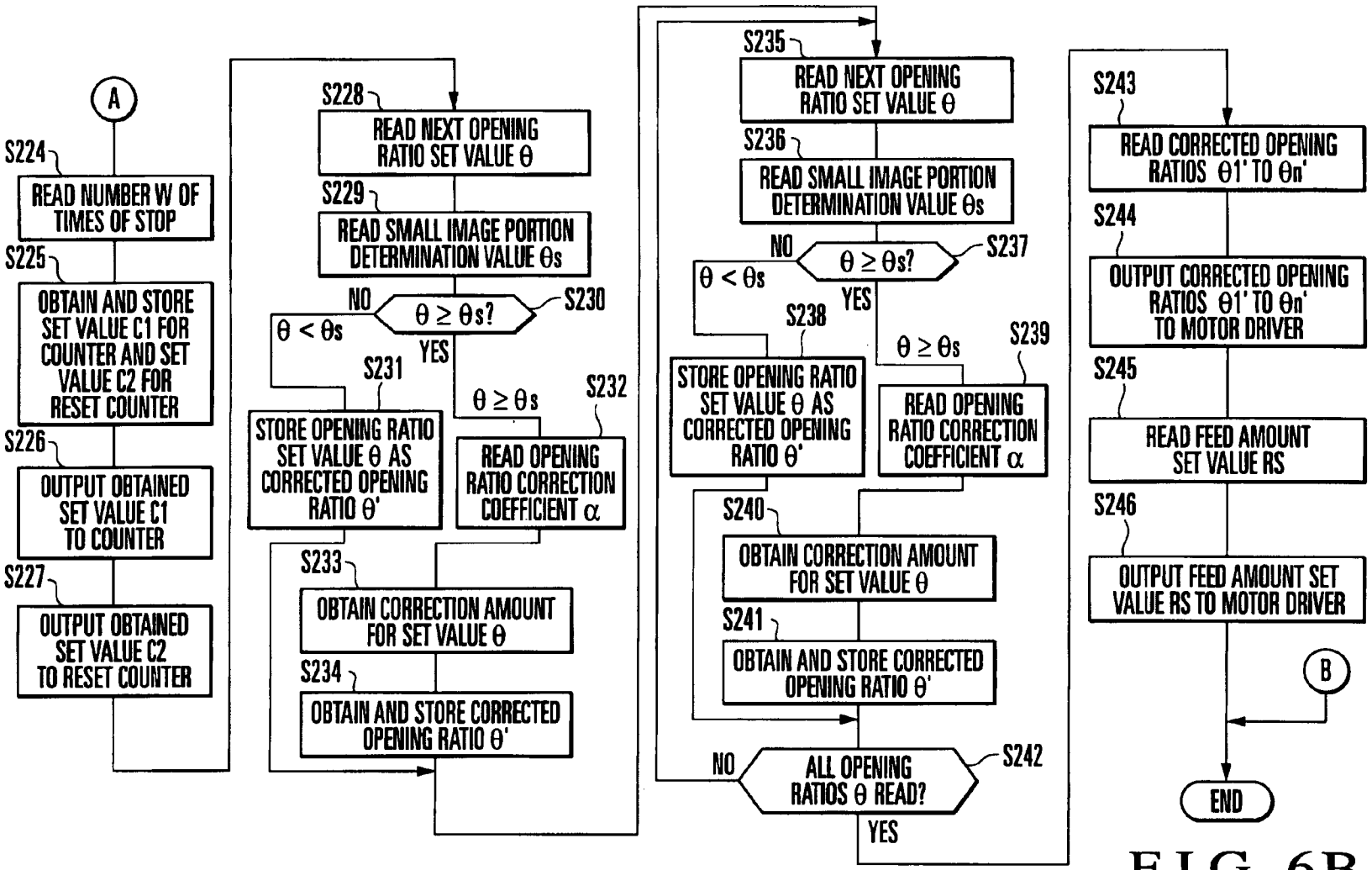
Figure 9A:
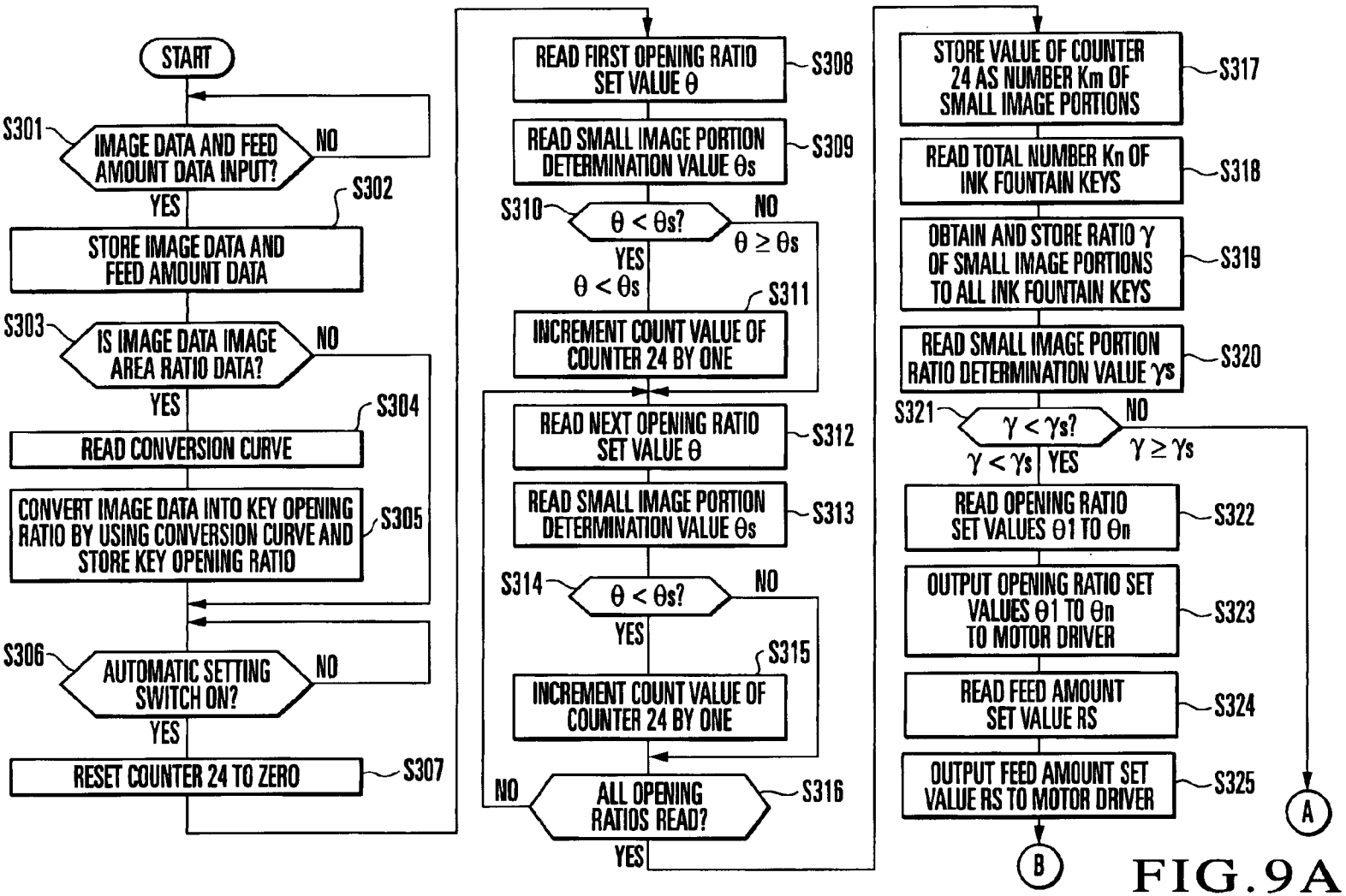
FIGS. 9A and 9B are flow charts for explaining the operation (operation example 1) of the ink supply amount control apparatus shown in FIG. 8 before the start of printing.
Figure 9B:
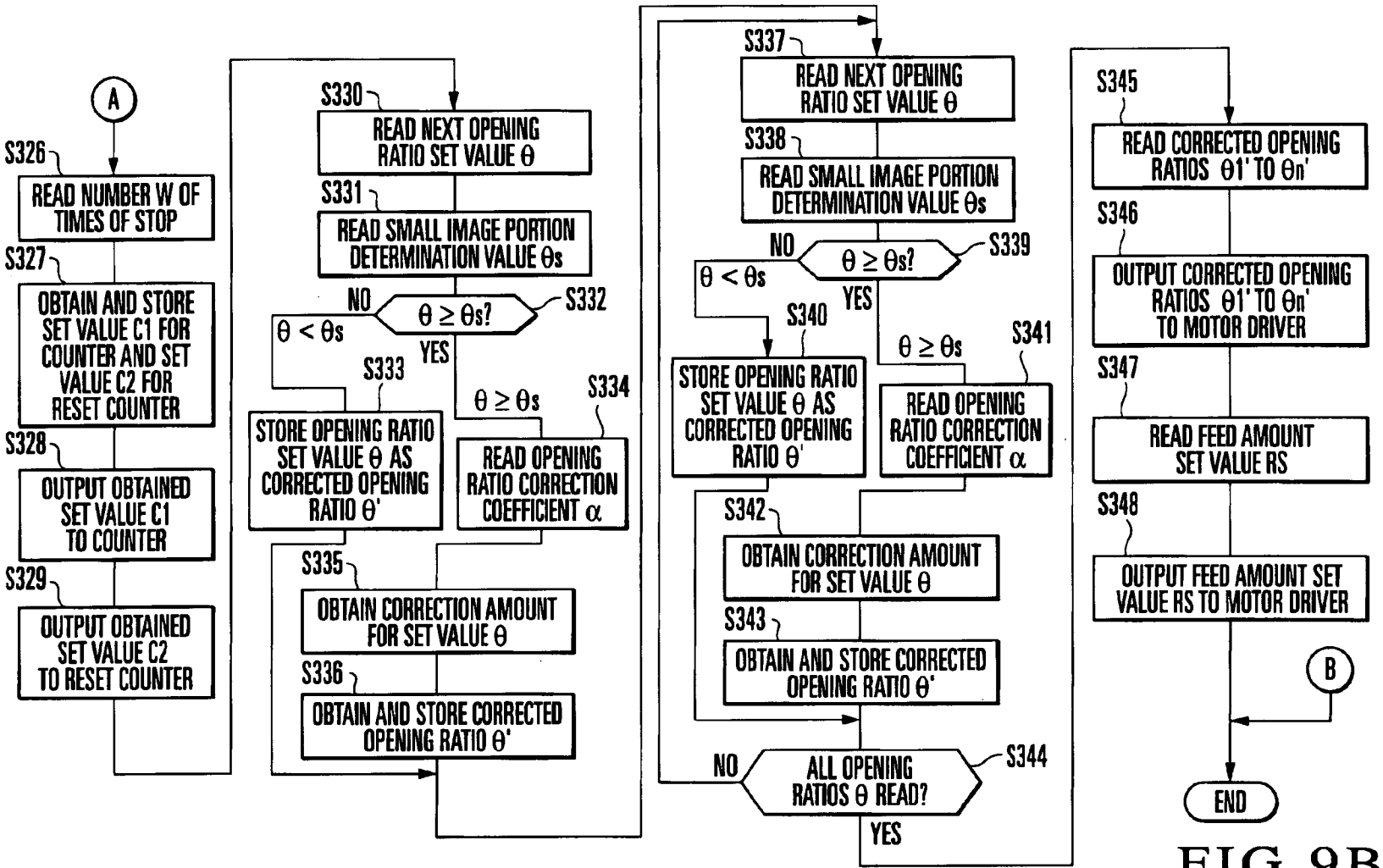

The operation in steps S301 to S317 in FIG. 9A is the same as that in steps S201 to S217 in FIG. 6A, and a description thereof will be omitted. When a number Km of small image portions is written in a memory M12 (step S317), the CPU 10 reads out the total number Kn of ink fountain keys in the printing unit 9, which is stored in the memory M14 (step S318).

The CPU 10 obtains a ratio γ (γ=Km/Kn) of small image portions to the total number of ink fountain keys in the printing unit 9 from the number Km of small image portions read out from the memory M12 and the total number Kn of ink fountain keys read out from the memory M14. The obtained ratio γ of small image portions to the total number of ink fountain keys is written in the memory M16 (step S319).

The CPU 10 reads out the small image portion ratio determination value γs of the printing unit 9 from the memory M15 (step S320) and compares the readout small image portion ratio determination value γs with the ratio γ of small image portions to the total number of ink fountain keys, which is obtained in step S319 (step S321).

If γ<γs, the CPU 10 determines that a printing plate 7 set on a plate cylinder 8 in the printing unit 9 has a small number of small image portions, and intermittent stop of the ink feed operation is unnecessary. In this case, by the processing operations in steps S322 to S325 corresponding to steps S220 to S223 in FIG. 6B, the opening ratios of the ink fountain keys 4 are adjusted to normal set values θ1 to θn. In addition, the feed amount of an ink fountain roller 3 at the time of printing is adjusted to a normal set value RS. The series of processing operations are thus ended.

To the contrary, if γ≧γs, the CPU 10 determines that the printing plate 7 set on the plate cylinder 8 in the printing unit 9 has a large number of small image portions, and intermittent stop of the ink feed operation is necessary. In this case, the CPU 10 adjusts the opening ratios of the ink fountain keys 4 to correction values θ1' to θn' by the processing operations in steps S326 to S348 corresponding to steps S224 to S246 in FIG. 6B.

In operation example 1, whether intermittent stop of the ink feed operation is to be executed is determined on the basis of the ratio of small image portions. The CPU 10 instructs intermittent stop of the ink feed operation on the basis of this determination. In accordance with this instruction, of the ink fountain key opening ratio set values θ1 to θn for the ink fountain keys 4, only the set values corresponding to large/medium image portions except small image portions are corrected to larger values. Since the ink supply amount to a large/medium image portion increases, the excess ink supply to a small image portion and a shortage of the ink supply amount to a large/medium image portion are simultaneously solved.

OPERATION EXAMPLE 2

Intermittent Stop+Ink Fountain Roller Feed Amount Correction

In operation example 1 described above, when the ink feed operation should intermittently be stopped, the ink fountain key opening ratio set values θ1 to θn are corrected in accordance with the image area ratio. In place of the ink fountain key opening ratio set values θ1 to θn, the set value RS of the feed amount of the ink fountain roller 3 may be corrected in accordance with the image area ratio.

Figure 7:
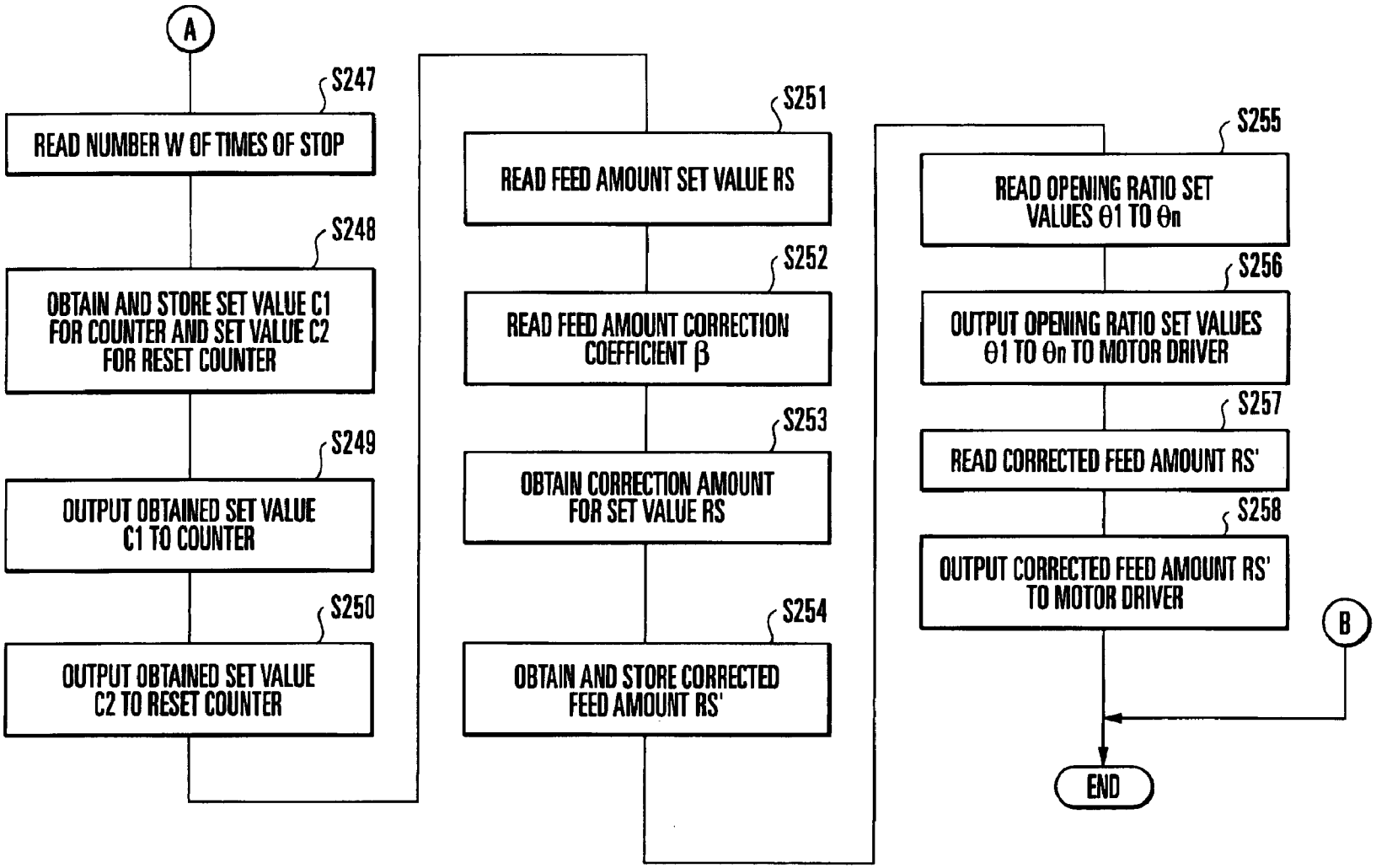
FIG. 7 is a flow chart for explaining the operation (operation example 2) of the ink supply amount control apparatus shown in FIG. 5 before the start of printing.
Figure 10:
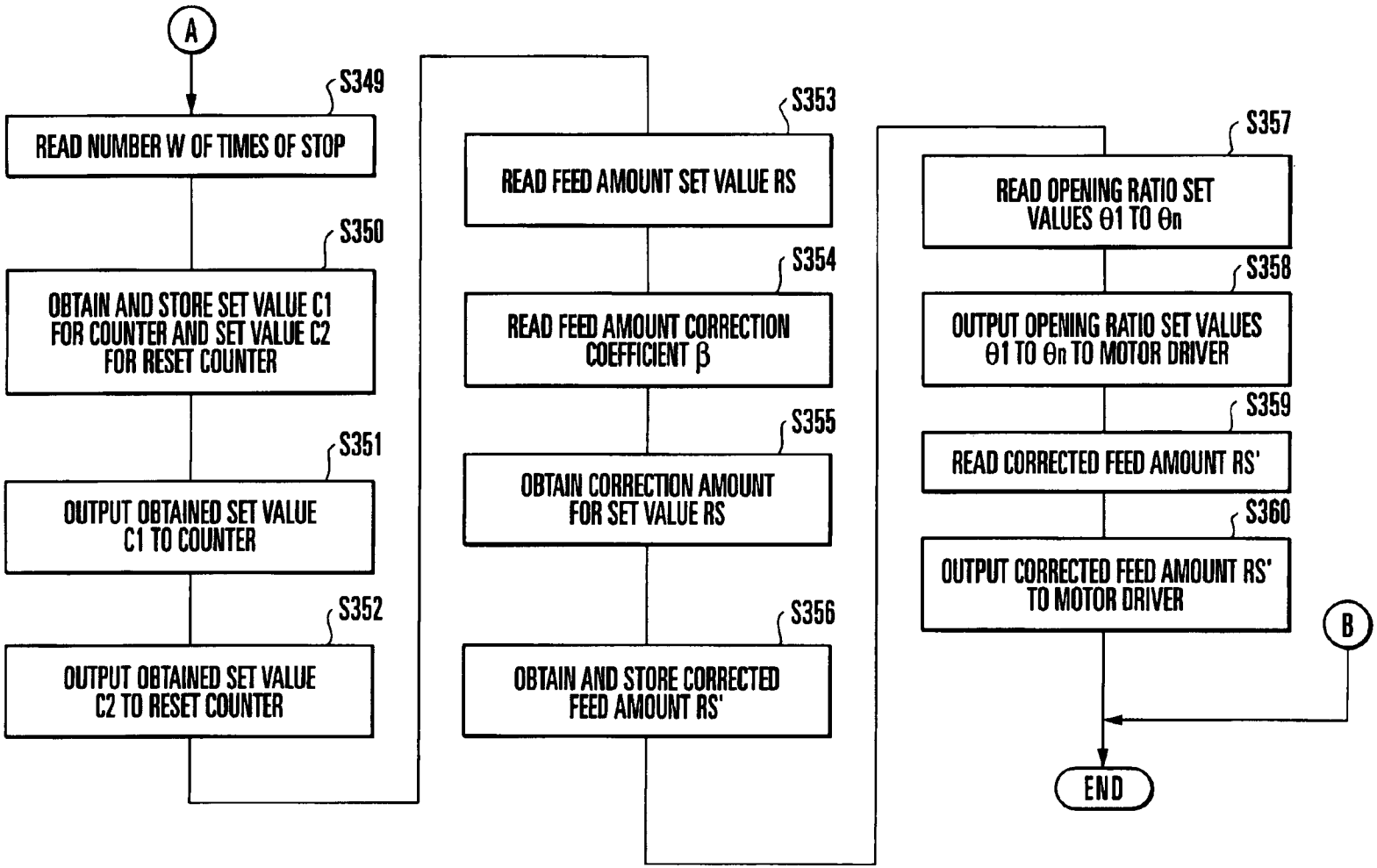
FIG. 10 is a flow chart for explaining the operation (operation example 2) of the ink supply amount control apparatus shown in FIG. 8 before the start of printing.

That is, if it is determined in step S321 (FIG. 9A) that γ≧γs, the feed amount of the ink fountain roller 3 may be adjusted to a correction value RS' by executing processing operations in steps S349 to S360 in FIG. 10 (processing operations corresponding to steps S247 to S258 in FIG. 7).

In operation example 2, whether intermittent stop of the ink feed operation is to be executed is automatically determined on the basis of the ratio of small image portions. The CPU 10 instructs intermittent stop of the ink feed operation on the basis of this determination. In accordance with this instruction, the feed amount set value RS for the ink fountain roller 3 is corrected to a larger value. Since the ink supply amount to a large/medium image portion increases more than that to a small image portion, the excess ink supply to a small image portion and a shortage of the ink supply amount to a large/medium image portion are simultaneously solved.

In operation example 2 described above, a small image portion determination value θs is obtained, and the number of ink fountain keys having values smaller than the small image portion determination value θs is counted as the number Km of small image portions. That is, the number of ink fountain keys whose ink fountain key opening ratio set values θ1 to θn satisfy θ<θs is counted as the number Km of small image portions. However, the number of ink fountain keys which satisfy θ<θ21 θs may be counted as the number Km of small image portions. When zero is excluded from the ink fountain key opening ratio set values θ1 to θn, an ink fountain key whose opening ratios at two ends are 0% and an ink fountain key of an unprinted portion are excluded. Only small image portions to be actually printed are counted as the number of small image portions.

[Fourth Embodiment]

In the above-described third embodiment, the ratio γ of the number Km of small image portions to the total number Kn of ink fountain keys in the printing unit 9 is obtained. The ratio γ may be obtained as a ratio of the number Km of small image portions not to the total number Kn of ink fountain keys but to a number Kx of ink fountain keys to be used for printing. The number Kx of ink fountain keys to be used for printing is obtained by, e.g., a method ① or ② to be described below. In these methods ① and ②, the number Km of small image portions equals the number of ink fountain keys for which the opening ratio set value is larger than zero and smaller than the small image portion determination value θs (0<θ<θs).

[① Method That Uses Paper Size Input as Preset Information]

When a total number n of ink fountain keys is an even number, paper size/ink fountain key width/2=a is calculated. The number Kx of ink fountain keys to be used for printing is obtained as Kx=(integral value obtained by carrying the fraction of a)×2. When the total number n of ink fountain keys is an odd number, [(paper size/ink fountain key width)−1]/2=a' is calculated. The number Kx of ink fountain keys to be used for printing is obtained as Kx=(integral value obtained by carrying the fraction of a')×2+1.

[② Method That Uses Image Data]

The number Kx of ink fountain keys to be used for printing is obtained as Kx=(total number n of ink fountain keys)−(number of ink fountain keys whose set value is 0%).

[Detailed Examples of Fourth Embodiment]

Figure 11:
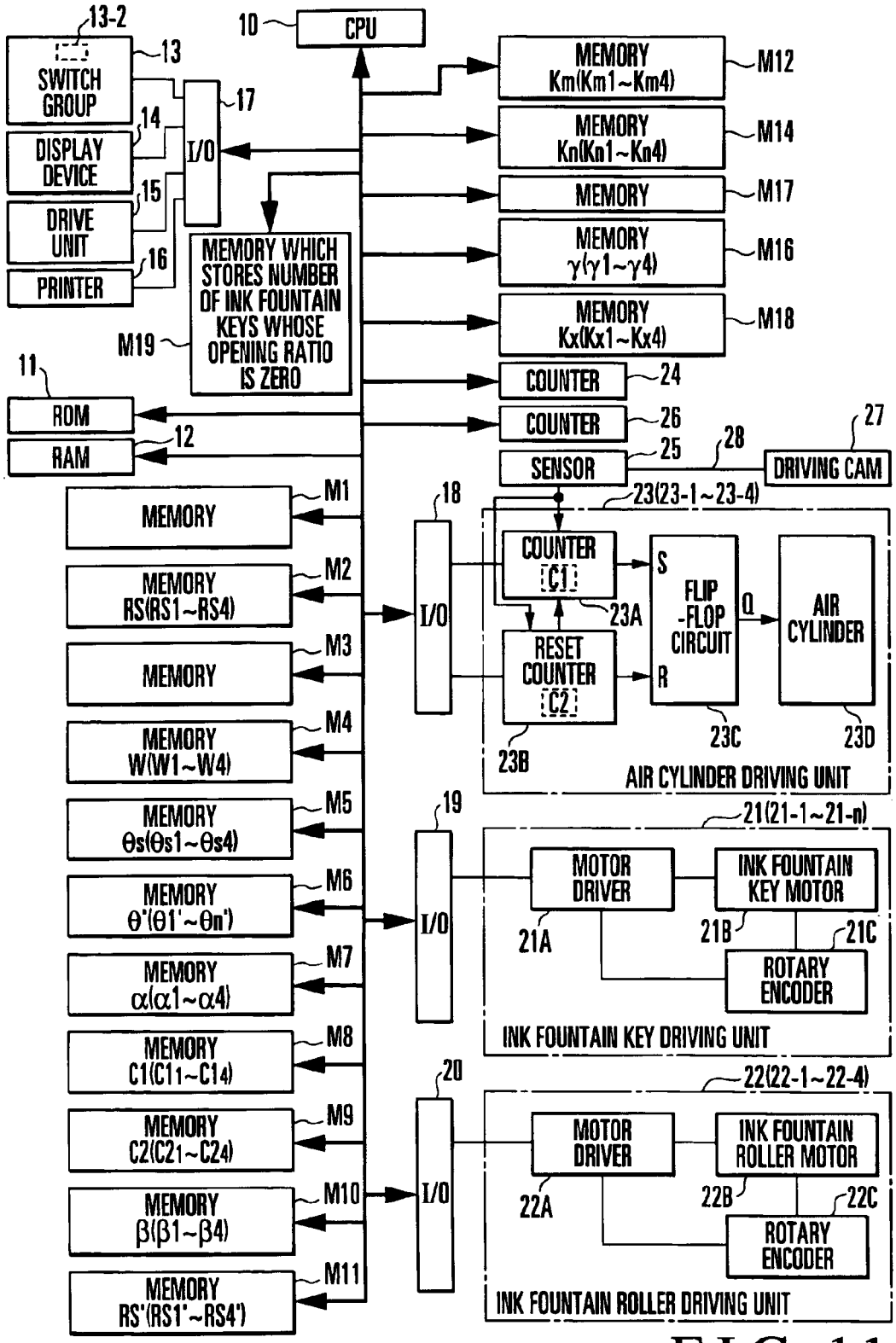
FIG. 11 is a block diagram of an ink supply amount control apparatus for a printing press according to the fourth embodiment of the present invention.

FIG. 11 shows an ink supply amount control apparatus to which the above-described method (method ②) that uses image data is applied. The same reference numerals as in FIG. 8 denote the same or similar constituent elements in FIG. 11, and a description thereof will be omitted. In the fourth embodiment, instead of the memory M15 which stores the ratio of small image portions to the total number of ink fountain keys in each printing unit in the third embodiment, a memory M17 which stores the ratio of small image portions to the number of ink fountain keys to be used for printing in each printing unit, a memory M18 which stores the number of ink fountain keys to be used for printing in each printing unit, and a memory M19 which stores the number of ink fountain keys whose opening ratio is zero are arranged. A counter 26 which counts the number of ink fountain keys whose opening ratio is zero is also arranged.

[Determination of Necessity of Intermittent Stop of Ink Feed Operation]

Figure 12A:
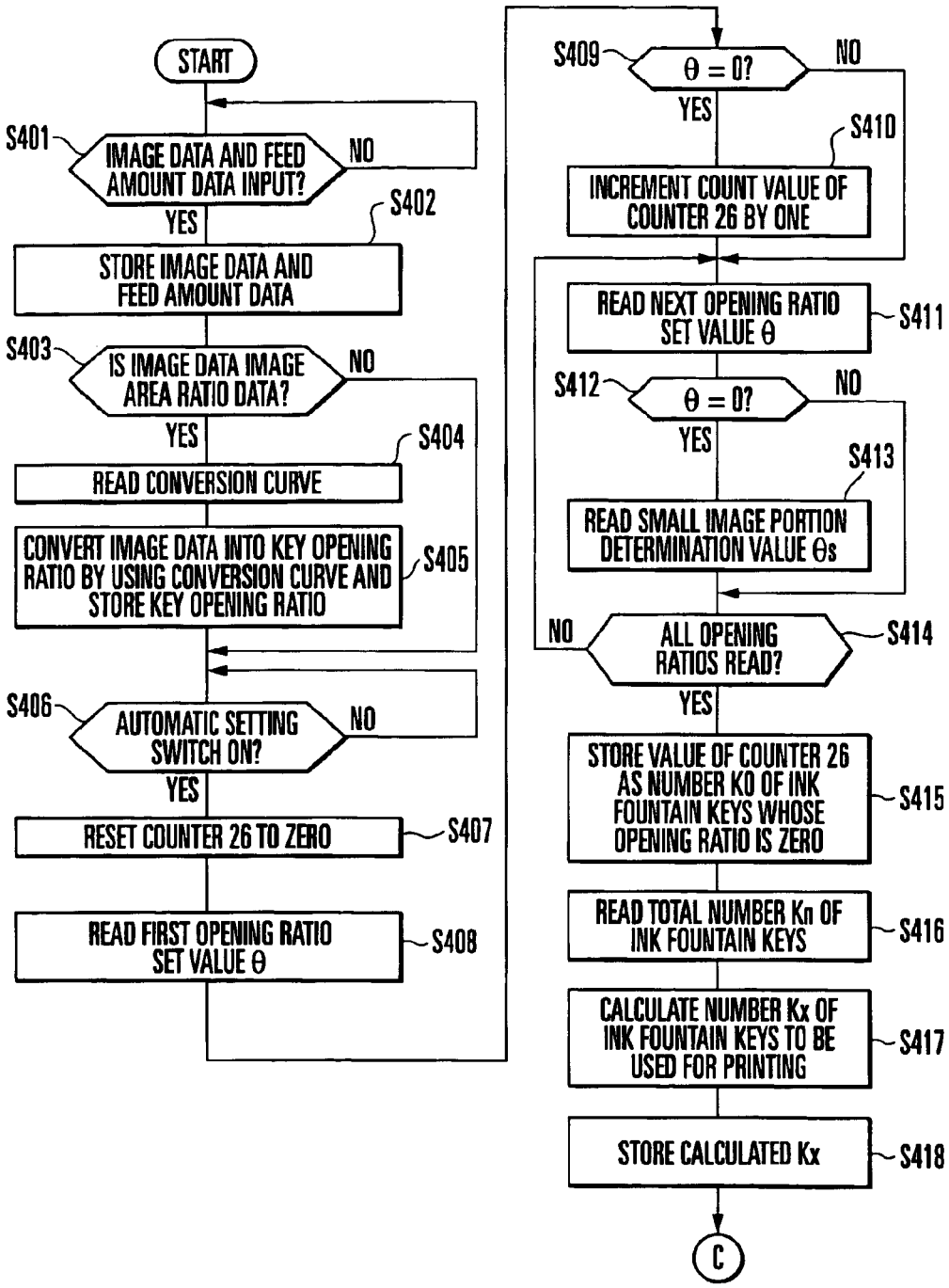
FIGS. 12A and 12B are flow charts for explaining the operation (operation example 1) of the ink supply amount control apparatus shown in FIG. 11 before the start of printing.
Figure 12B:
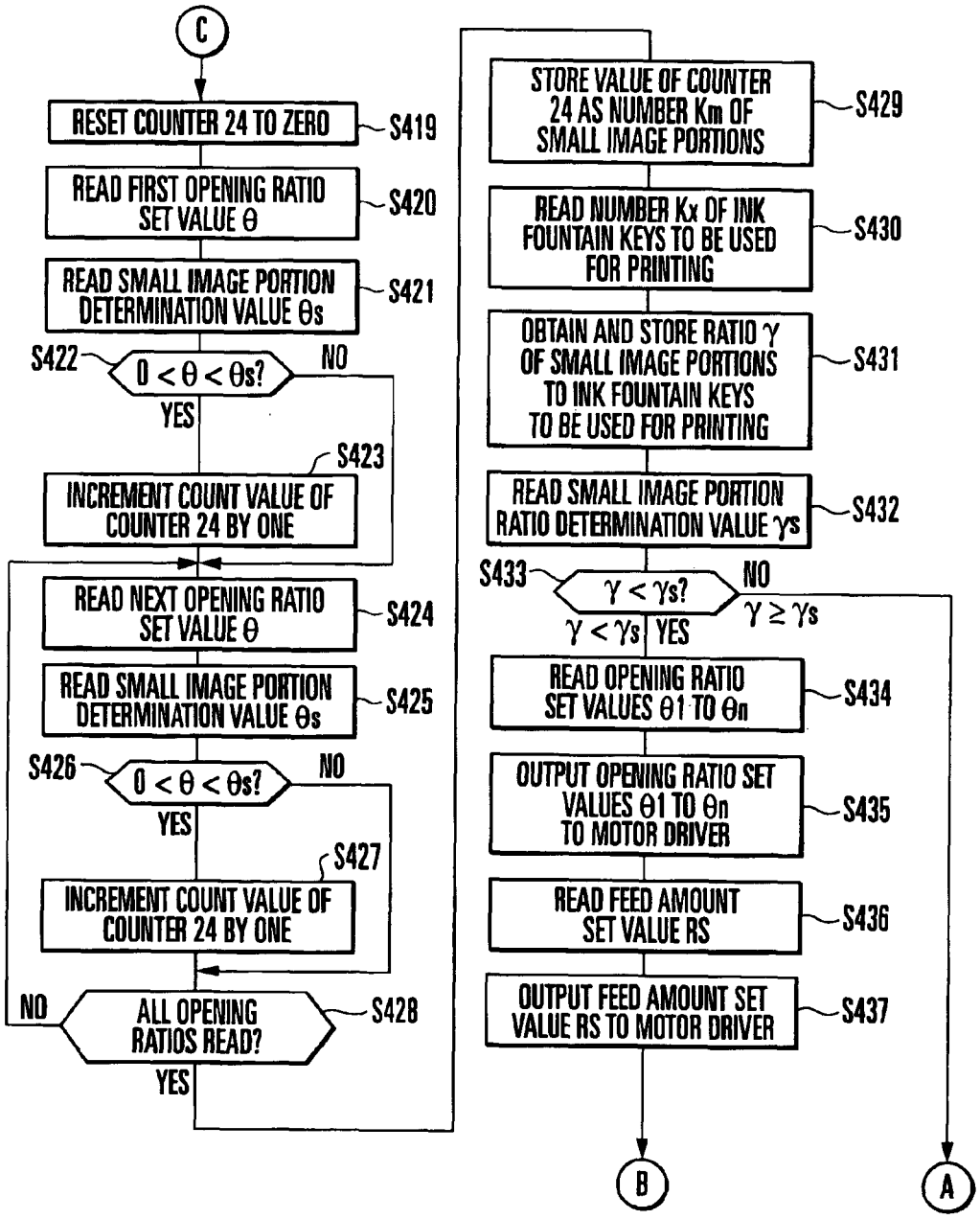

The operation of determining whether intermittent stop of the ink feed operation in the ink supply amount control apparatus should be executed will be described with reference to FIGS. 12A and 12B. The operation in steps S401 to S406 in FIG. 12A is the same as in steps S301 to S306 in FIG. 9A, and a description thereof will be omitted.

When an automatic setting switch 13-2 is turned on by the operator (YES in step S406), a CPU 10 resets the count value of the counter 26 to zero (step S407) and reads out a first ink fountain key opening ratio set value θ1 from a memory M1 (step S408). It is checked whether the ink fountain key opening ratio set value θ1 is not zero (step S409). If θ1=0, the count value of the counter 26 which counts the number of ink fountain keys whose opening ratio is zero is incremented by one (step S410). If θ1≠0, the flow immediately advances to step S411.

In step S411, the CPU 10 reads out the next ink fountain key opening ratio set value θ2 from the memory M1. The CPU 10 checks whether the ink fountain key opening ratio set value θ2 is not zero (step S412). If θ2=0, the count value of the counter 26 which counts the number of ink fountain keys whose opening ratio is zero is incremented by one (step S413). If θ2≠0, the flow immediately advances to step S414.

In the same way, the CPU 10 repeats the operation in steps S411 to S413 until the read of all ink fountain key opening ratio set values θ from the memory M1 is confirmed (step S414). With this operation, the counter 26 counts, of ink fountain keys 4, the number of ink fountain keys whose opening ratio set value θ is determined as zero. The CPU 10 writes the value counted by the counter 26 in the memory M19 as a number K0 of ink fountain keys whose opening ratio is zero (step S415).

Next, the CPU 10 reads out the total number Kn of ink fountain keys of a printing unit 9 from the memory M14 (step S416). The number K0 of ink fountain keys whose opening ratio is zero, which is obtained in step S415, is subtracted from the readout total number Kn of ink fountain keys in the printing unit 9, thereby calculating the number Kx of ink fountain keys to be used for printing (step S417). The calculated number Kx of ink fountain keys is written in the memory M18 (step S418).

Next, the CPU 10 resets the count value of a counter 24 to zero (step S419). The CPU 10 reads out the first ink fountain key opening ratio set value θ1 from the memory M1 and a small image portion determination value θs from a memory M5 (steps S420 and S421). The CPU 10 checks whether the ink fountain key opening ratio set value θ1 satisfies 0<θ1<θs (step S422). If YES in step S422, the count value of the small image portion counter 24 is incremented by one (step S423). If NO in step S422, the flow immediately advances to step S424.

More specifically, if 0<θ1<θs, the area of a printing plate 7, which corresponds to an ink fountain key 4-1, is determined as a small image portion. The count value of the small image portion counter 24 is incremented by one. If 0<θ1<θs is not satisfied, the area of the printing plate 7, which corresponds to the ink fountain key 4-1, is determined as a large/medium image portion or a portion that is not used for printing. The flow immediately advances to step S424 without incrementing the count value of the small image portion counter 24.

In step S424, the CPU 10 reads out the next ink fountain key opening ratio set value θ2 from the memory M1. The CPU 10 also reads out the small image portion determination value θs from the memory M5 (step S425). The CPU 10 checks whether the ink fountain key opening ratio set value θ2 satisfies 0<θ2<θs (step S426). If YES in step S426, the count value of the small image portion counter 24 is incremented by one (step S427). If NO in step S426, the flow immediately advances to step S428.

In the same way, the CPU 10 repeats the operation in steps S424 to S427 until the read of all ink fountain key opening ratio set values θ from the memory M1 is confirmed (step S428). With this operation, the small image portion counter 24 counts the number of ink fountain keys (the number of small image portions), of the ink fountain keys 4, which are determined as small image portions because the opening ratio set values θ satisfy 0<θ<θs. The CPU 10 writes in a memory M12 as Km the number of small image portions counted by the small image portion counter 24 (step S429) and reads out the number Kx of ink fountain keys to be used for printing in the printing unit 9 from the memory M18 (step S430).

The CPU 10 obtains a ratio γ (γ=Km/Kx) of small image portions to the number of ink fountain keys to be used for printing in the printing unit 9 from the number Km of small image portions read out from the memory M12 and the number Kx of ink fountain keys to be used for printing, which is read out from the memory M18. The CPU 10 writes the obtained ratio γ of small image portions to the number of ink fountain keys to be used for printing in a memory M16 (step S431).

The CPU 10 reads out a small image portion ratio determination value γs of the printing unit 9 from the memory M17 (step S432) and compares the readout small image portion ratio determination value γs with the ratio γ of small image portions to the number of ink fountain keys to be used for printing, which is obtained in step S431 (step S433).

If γ<γs, it is determined that the printing plate 7 set on a plate cylinder 8 in the printing unit 9 has a small number of small image portions, and intermittent stop of the ink feed operation is unnecessary. In this case, by the processing operations in steps S434 to S437 corresponding to steps S322 to S325 in FIG. 9A, the opening ratios of the ink fountain keys 4 are adjusted to the normal set values θ1 to θn. In addition, the feed amount of an ink fountain roller 3 at the time of printing is adjusted to a normal set value RS. The series of processing operations are thus ended.

To the contrary, if γ≧γs, it is determined that the printing plate 7 set on the plate cylinder 8 in the printing unit 9 has a large number of small image portions, and intermittent stop of the ink feed operation is necessary. In this case, the CPU 10 adjusts the opening ratios of the ink fountain keys 4 to correction values θ1' to θn' by the processing operations (operation example 1) corresponding to steps S326 to S348 in FIG. 9B. Alternatively, the feed amount of the ink fountain roller 3 at the time of printing is adjusted to a correction value RS' by the processing operations (operation example 2) corresponding to steps S349 to S360 in FIG. 10.

[Fifth Embodiment: Manual Method]

Figure 13:
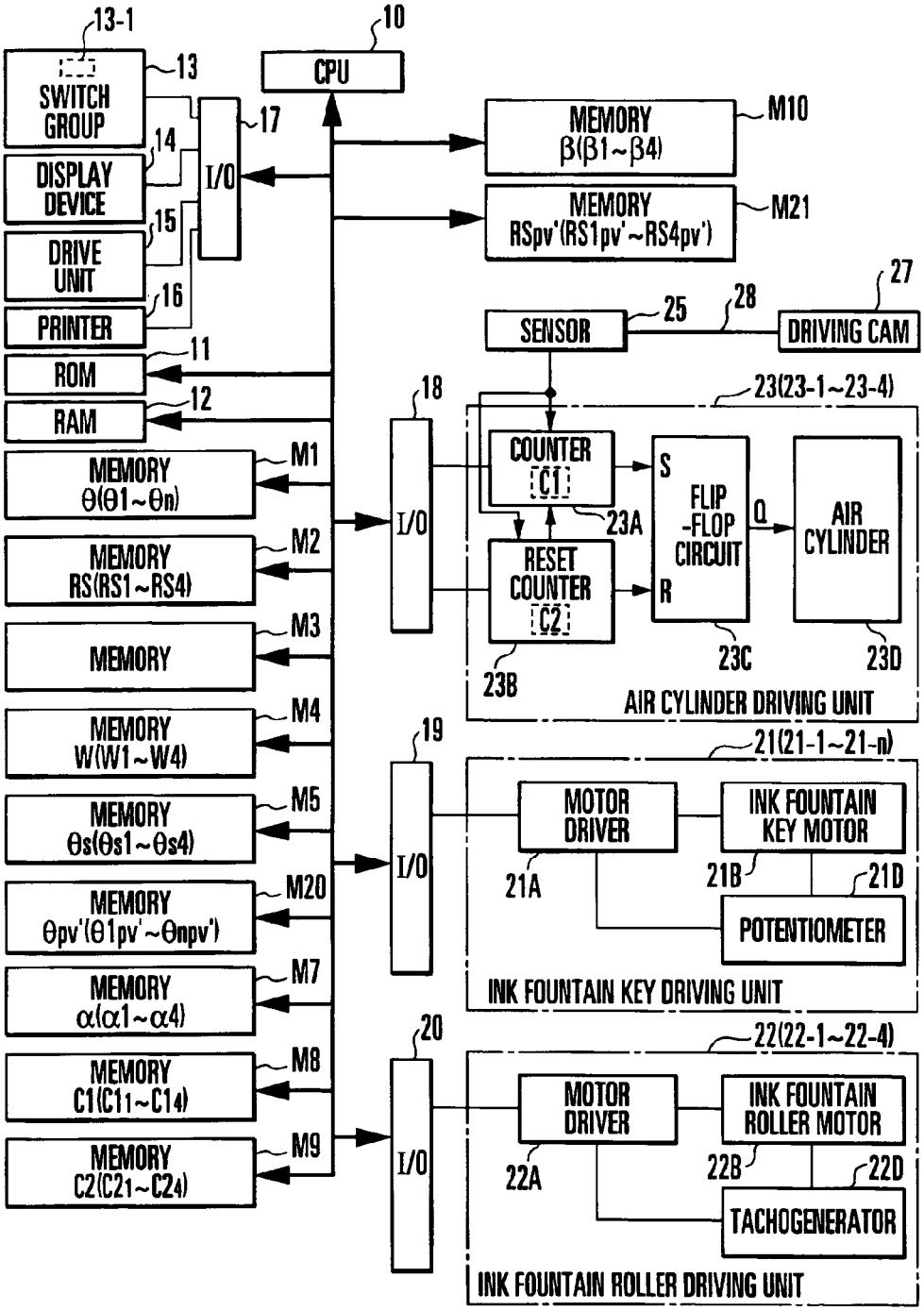
FIG. 13 is a block diagram of an ink supply amount control apparatus for a printing press according to the fifth embodiment of the present invention.

In the manual method according to the first embodiment, the opening ratio set value θ of the ink fountain key 4 or the feed amount set value RS of the ink fountain roller 3 is corrected. In the manual method according to the fifth embodiment, however, an actual value θpv of the opening ratio of an ink fountain key 4 or an actual value RSpv of the feed amount of an ink fountain roller 3 is corrected. In the ink supply amount control apparatus according to the fifth embodiment shown in FIG. 13, a potentiometer 21D replaces a rotary encoder 21C of an ink fountain key driving unit 21 shown in FIG. 1, and a tachogenerator 22D replaces a rotary encoder 22C of an ink fountain roller driving unit 22.

OPERATION EXAMPLE 1

Intermittent Stop+Ink Fountain Key Opening Ratio Correction

A characteristic operation (operation example 1) of the ink supply amount control apparatus before the start of printing will be described with reference to FIGS. 14A and 14B. The same operation is executed in all printing units 9, and the operation in one printing unit 9 will be described here.

Even in the fifth embodiment, ink fountain key opening ratio set values θ1 to θn are stored in a memory M1, and an ink fountain roller feed amount set value RS is set in a memory M2 by processing operations in steps S501 to S505 corresponding to steps S101 to S105 in FIG. 2A.

A CPU 10 reads out the ink fountain key opening ratio set values θ1 to θn from the memory M1 (step S506) and sends the readout ink fountain key opening ratio set values θ1 to θn to an ink fountain key motor driver 21A of the ink fountain key driving unit 21 (step S507). Accordingly, an ink fountain key motor 21B is driven to adjust the opening ratios of the ink fountain keys 4 in the printing unit 9 to the set values θ1 to θn.

Next, the CPU 10 reads out the ink fountain roller feed amount set value RS from the memory M2 (step S508) and sends the readout ink fountain roller feed amount set value RS to an ink fountain roller motor driver 22A of the ink fountain roller driving unit 22 (step S509). Accordingly, at the time of printing, the feed amount of the ink fountain roller 3 in the printing unit 9 is adjusted to the set value RS.

[Preparation for Intermittent Stop of Ink Feed Operation]

The CPU 10 determines the presence/absence of the input of a number W of times of stop of an ink ductor roller 5 in the printing unit 9 (step S510). When the number W of times of stop is input by the operator's key operation on a switch group 13, the number W of times of stop is written in a memory M4 (step S511).

By processing operations in steps S512 to S514 corresponding to steps S108 to S110 in FIG. 2A, a set value C1 and set value C2 for a counter 23A and reset counter 23B in an air cylinder driving unit 23 are set. With this operation, preparation for intermittent stop of the ink feed operation of the ink ductor roller 5 in the printing unit 9 is done.

[Ink Fountain Key Opening Ratio Correction]

The CPU 10 determines whether a correction button 13-1 of the switch group 13 is turned on (step S515). When the operator checks the result of test printing before the start of printing and presses the correction button 13-1, the opening ratio of each ink fountain key is corrected in the following way.

The CPU 10 reads an actual value θ1pv of an ink fountain key opening ratio from the potentiometer 21D of the first ink fountain key (step S516). The CPU 10 also reads out a small image portion determination value θs from a memory M5 (step S517). The read actual value θ1pv of the ink fountain key opening ratio is compared with the small image portion determination value θs (step S518). If θ1pv<θs, the flow advances to step S519. If θ1pv≧θs, the flow advances to step S520.

If θ1pv<θs, the area of a printing plate 7, which corresponds to an ink fountain key 4-1, is determined as a small image portion. The actual value θ1pv of the ink fountain key opening ratio, which is read from the potentiometer 21D, is directly written in a memory M20 as θ1pv' (step S519).

If θ1pv≧θs, the area of the printing plate 7, which corresponds to the ink fountain key 4-1, is determined as a large/medium image portion. A correction coefficient α is read out from a memory M7 (step S520). The CPU 10 multiplies the actual value θ1pv of the ink fountain key opening ratio, which is read from the potentiometer 21D, by the correction coefficient α to obtain a correction amount for the actual value θ1pv (step S521). The CPU 10 adds the correction amount to the actual value θ1pv to obtain an ink fountain key opening ratio correction value θ1pv' and writes it in the memory M20 (step S522). With this operation, the actual value θ1pv of the opening ratio of the ink fountain key 4-1 whose corresponding area is determined as a large/medium image portion is corrected such that it increases by the product of the actual value θ1pv and the correction coefficient α.

The CPU 10 reads an actual value θ2pv of the ink fountain key opening ratio from the potentiometer 21D of the next ink fountain key (step S523). The CPU 10 also reads out the small image portion determination value θs from the memory M5 (step S524). The CPU 10 compares the actual value θ2pv of the ink fountain key opening ratio with the small image portion determination value θs (step S525). If θ2pv<θs, the actual value θ2pv is directly written in the memory M20 as θ2pv', as in step S519 (step S526).

If θ2pv≧θs, as in steps S520 to S522, the correction coefficient α is read out from the memory M7 (step S527). The actual value θ2pv is multiplied by the correction coefficient α to obtain a correction amount (step S528). A value obtained by adding the correction amount to the actual value θ2pv is written in the memory M20 as θ2pv' (step S529).

In the same way, the CPU 10 repeats the operation in steps S523 to S530 until the read of the actual values θpv of the ink fountain key opening ratios from the potentiometers 21D of all ink fountain keys is confirmed in step S530. With this operation, the ink fountain key opening ratio correction values θ1pv' to θnpv' are stored in the memory M20.

The ink fountain key opening ratio correction values θ1pv' to θnpv' stored in the memory M20 are not actually corrected when the actual value θpv is smaller than the small image portion determination value θs. The opening ratio correction values θ1' to θn' are corrected when the actual value θpv is larger than the small image portion determination value θs. That is, the actual values θ1 to θn of the opening ratios of the ink fountain keys 4 are not corrected when the corresponding area is a small image portion (θpv<θs). Only for a large/medium image portion (θpv≧θs), the actual values θ1 to θn are corrected to larger values.

The CPU 10 determines whether storage of the ink fountain key opening ratio correction values θ1pv' to θnpv' in the memory M20 is ended (step S530). If YES in step S530, the CPU 10 reads out the ink fountain key opening ratio correction values θ1pv' to θnpv' from the memory M20 (step S531) and sends the readout ink fountain key opening ratio correction values θ1pv' to θnpv' to the motor driver 21A of the ink fountain key driving unit 21 (step S532). The ink fountain key motor 21B is driven to adjust the opening ratios of the ink fountain keys 4 in the printing unit 9 to the correction values θ1pv' to θnpv'.

OPERATION EXAMPLE 2

Intermittent Stop+Ink Fountain Roller Feed Amount Correction

In operation example 1 described above, when the ink feed operation should intermittently be stopped, the actual values θ1pv to θnpv of the ink fountain key opening ratios are corrected in accordance with the image area ratio. In place of the actual values θ1pv to θnpv of the ink fountain key opening ratios, the actual value RSpv of the feed amount of the ink fountain roller 3 may be corrected in accordance with the image area ratio.

In operation example 2 to be described below, the actual value RSpv of the feed amount of the ink fountain roller 3 is corrected to a larger value. With this operation, the ink supply amount to the large/medium image portion that requires a higher ink fountain key opening ratio is increased as compared to a small image portion that requires a low ink fountain key opening ratio.

Figure 14A:
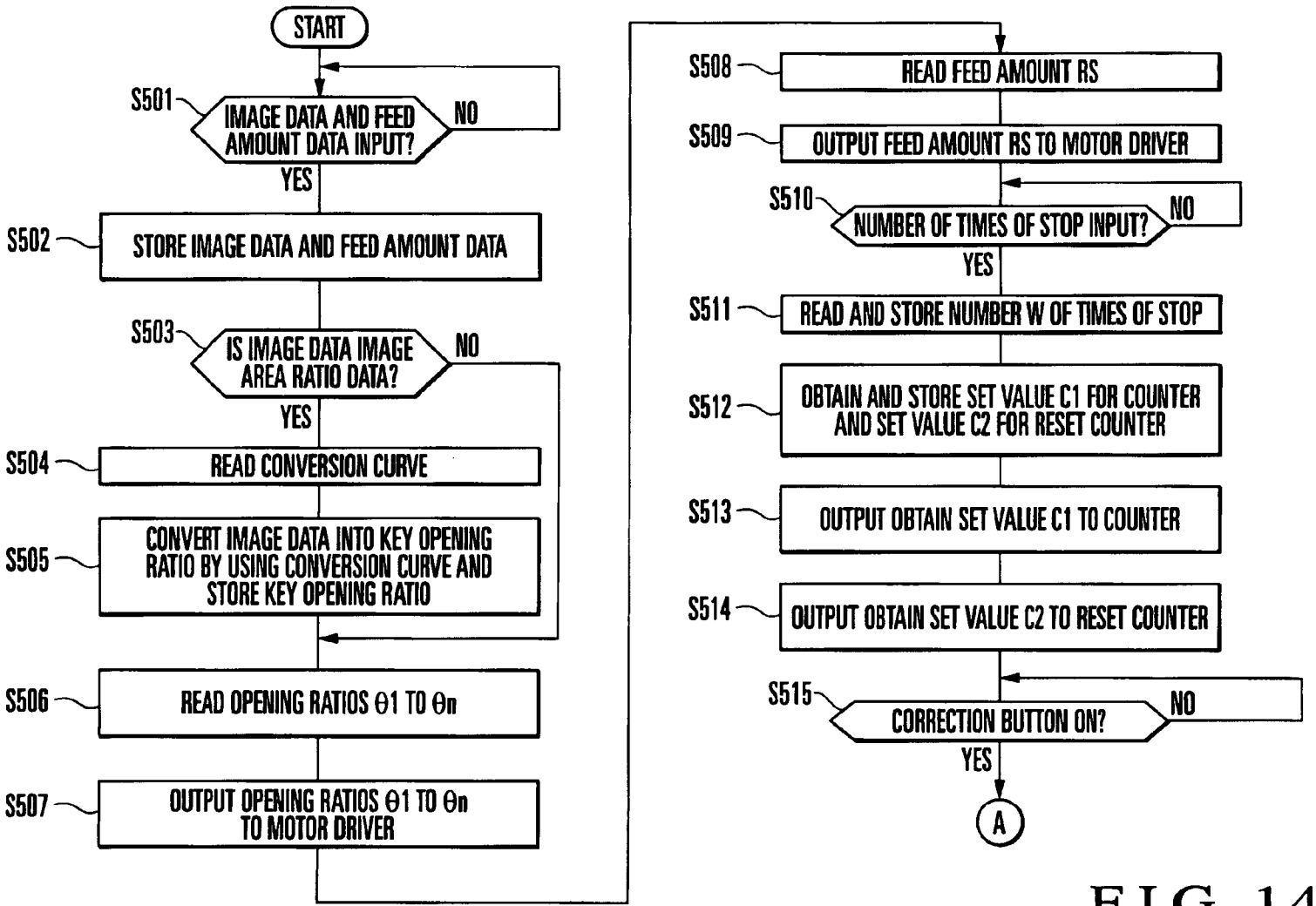
FIGS. 14A and 14B are flow charts for explaining the operation (operation example 1) of the ink supply amount control apparatus shown in FIG. 13 before the start of printing.
Figure 14B:
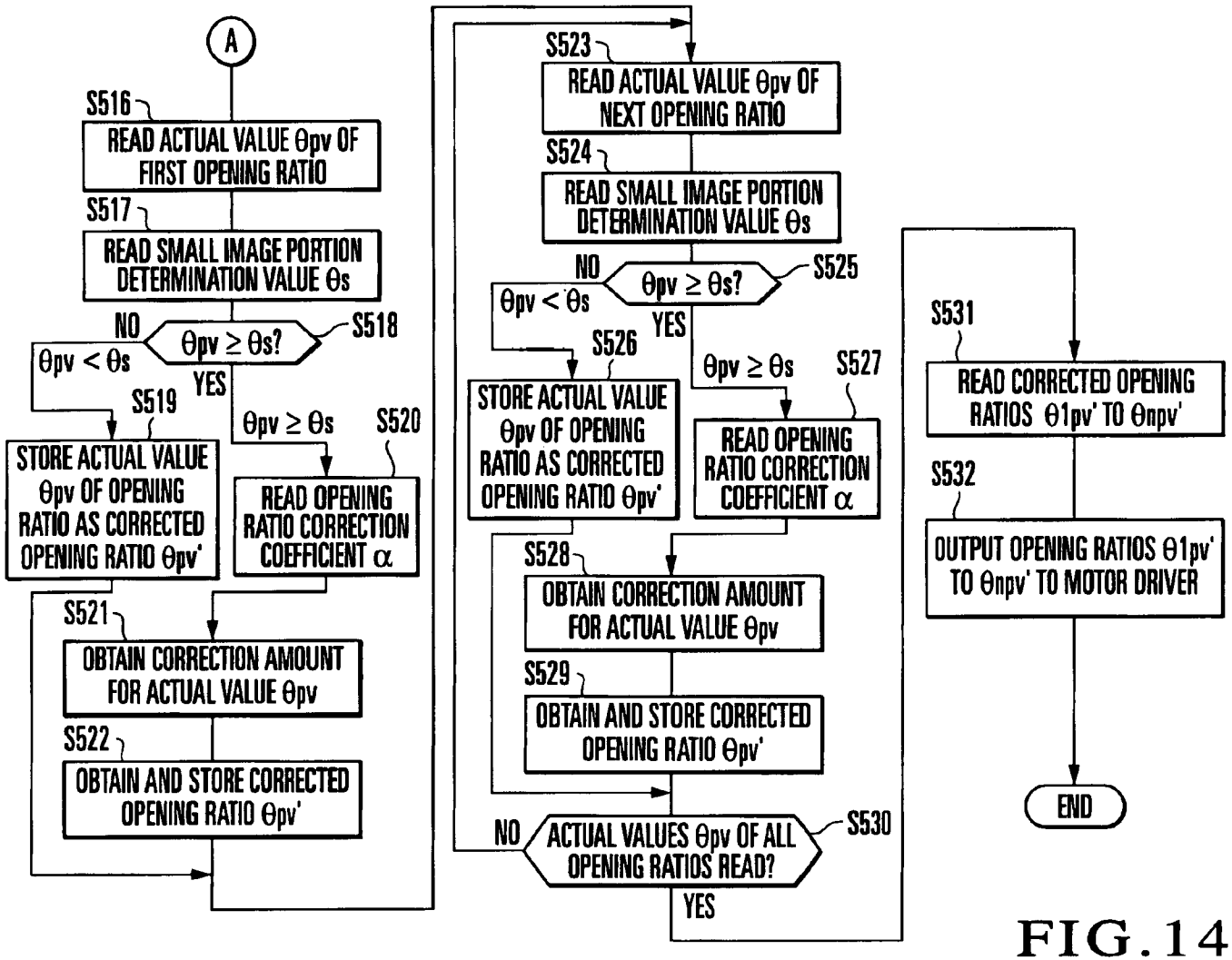
Figure 15:
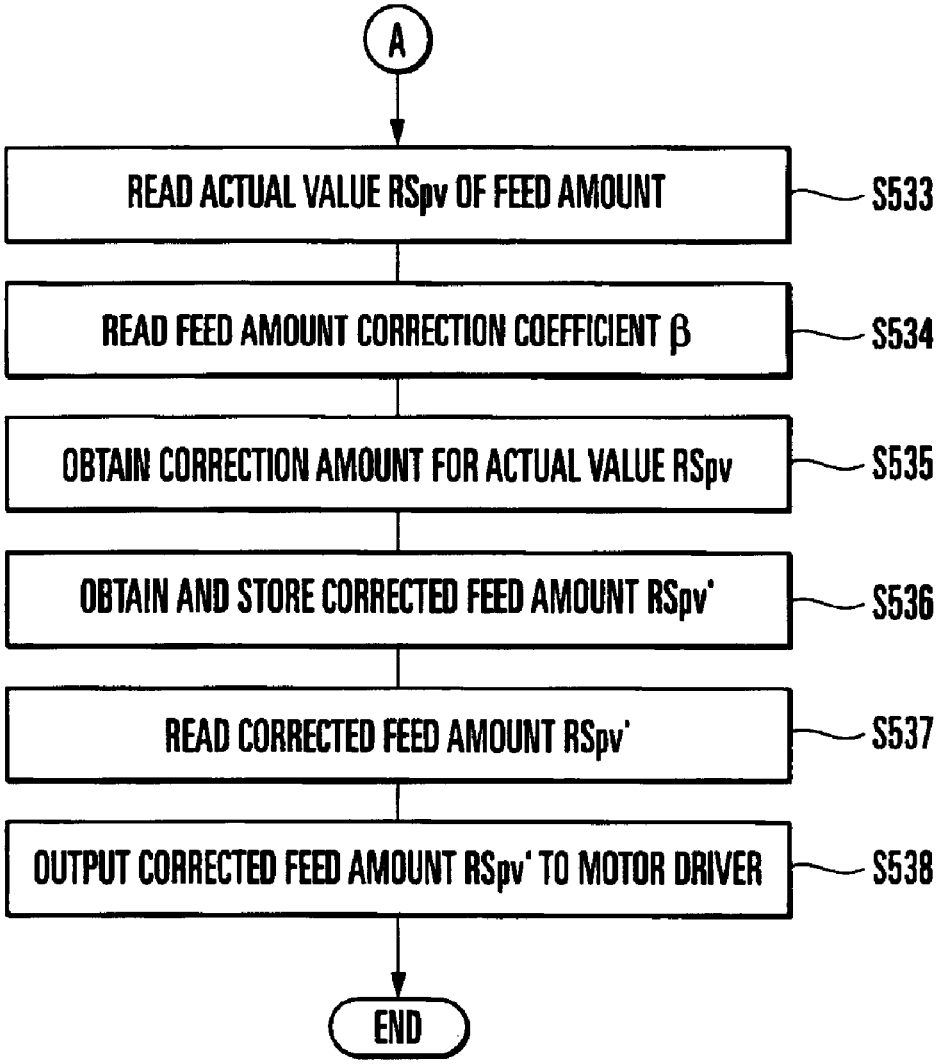
FIG. 15 is a flow chart for explaining the operation (operation example 2) of the ink supply amount control apparatus shown in FIG. 13 before the start of printing.
Figure 16:
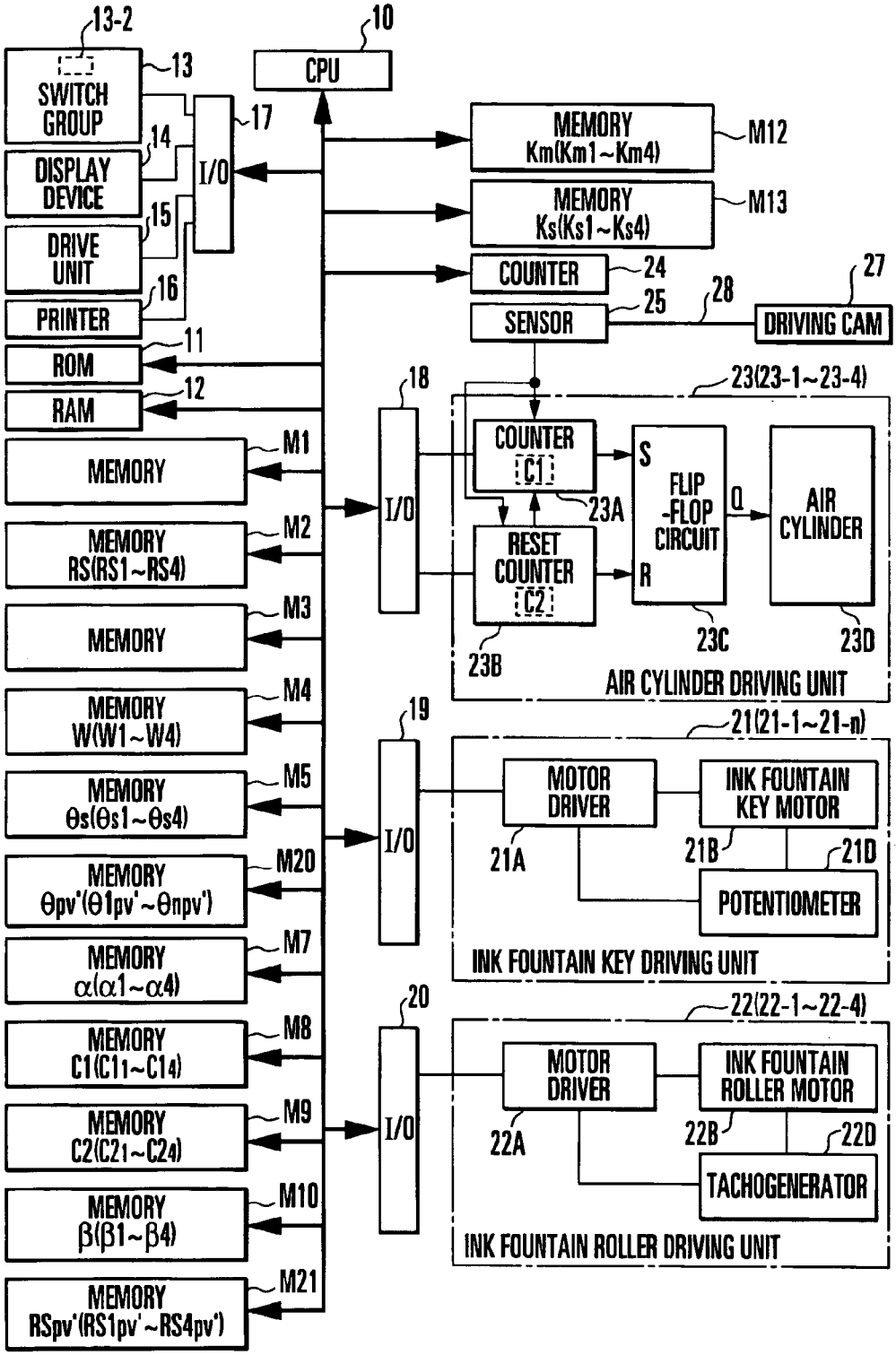
FIG. 16 is a block diagram of an ink supply amount control apparatus for a printing press according to the sixth embodiment of the present invention.

FIG. 15 shows a flow chart that follows step S515 in FIG. 14A. The operation until step S515 is the same as in operation example 1, and a description thereof will be omitted.

When it is determined that the printing product has a small image, and the operator presses the correction button 13-1 in step S515, the CPU 10 reads the actual value RSpv of the ink fountain roller feed amount from the tachogenerator 22D (step S533). A correction coefficient β is read out from the memory M10 (step S534). The actual value RSpv of the ink fountain roller feed amount, which is read from the tachogenerator 22D, is multiplied by the correction coefficient β to obtain the correction amount for the actual value RSpv (step S535).

Next, the CPU 10 adds the correction amount to the actual value RSpv of the ink fountain roller feed amount, which is read from the tachogenerator 22D, to obtain an ink fountain roller feed amount correction value RSpv' (RSpv'=(1+β)·RSpv) and writes it in a memory M21 (step S536). Accordingly, the actual value RSpv of the feed amount of the ink fountain roller 3 is corrected to be larger by the product of the actual value RSpv and the correction coefficient β.

The CPU 10 reads out the ink fountain roller feed amount correction value RSpv' from the memory M21 (step S537) and sends the readout ink fountain roller feed amount correction value RSpv' to the ink fountain roller motor driver 22A of the ink fountain roller driving unit 22 (step S538). Accordingly, at the time of printing, the feed amount of the ink fountain roller 3 in the printing unit 9 is adjusted to the correction value RSpv'.

[Sixth Embodiment: Automatic Method]

In the automatic method described in the second embodiment, the opening ratio set value θ of the ink fountain key 4 or the feed amount set value RS of the ink fountain roller 3 is corrected. In the automatic method according to the sixth embodiment, instead of correcting these values, an actual value θpv of the opening ratio of an ink fountain key 4 or an actual value RSpv of the feed amount of an ink fountain roller 3 is corrected.

Figure 21:
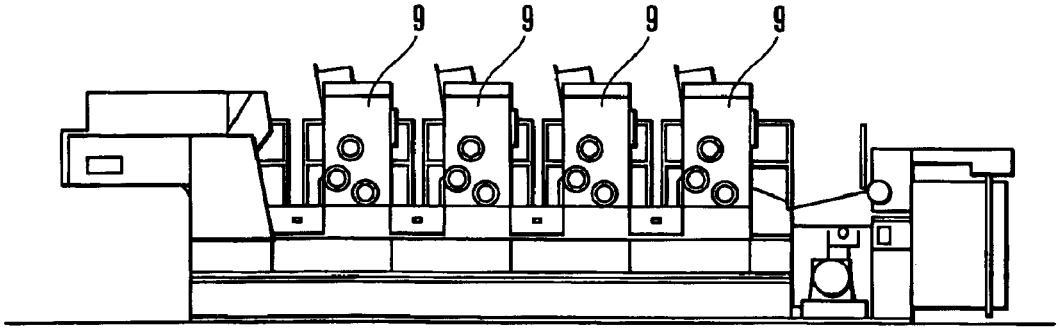
FIG. 21 is a side view showing the schematic arrangement of a four-color rotary printing press.

In the ink supply amount control apparatus according to the sixth embodiment shown in FIG. 21, the number of ink fountain keys whose actual value θpv of the ink fountain key opening ratio is smaller than a small image portion determination value θs is counted. When the counted number of ink fountain keys is larger than Ks, it is determined that the number of times of ink feed operation must be thinned.

OPERATION EXAMPLE 1

Intermittent Stop+Ink Fountain Key Opening Ratio Correction

A characteristic operation (operation example 1) of the ink supply amount control apparatus before the start of printing will be described with reference to FIGS. 17A and 17B. The same operation is executed in all printing units 9, and the operation in one printing unit 9 will be described here.

[Read and Storage of Image Data and Feed Amount Data]

Even in the sixth embodiment, ink fountain key opening ratio set values θ1 to θn are stored in a memory M1, and an ink fountain roller feed amount set value RS is set in a memory M2 by processing operations in steps S601 to S605 corresponding to steps S201 to S205 in FIG. 6A.

The ink fountain key opening ratio set values θ1 to θn are read out from the memory M1 (step S606) and sent to an ink fountain key motor driver 21A of an ink fountain key driving unit 21 (step S607).

Accordingly, an ink fountain key motor 21B is driven to adjust the opening ratios of the ink fountain keys 4 in the printing unit 9 to the set values θ1 to θn.

Next, a CPU 10 reads out the ink fountain roller feed amount set value RS from the memory M2 (step S608) and sends the readout ink fountain roller feed amount set value RS to an ink fountain roller motor driver 22A of an ink fountain roller driving unit 22 (step S609). Accordingly, at the time of printing, the feed amount of the ink fountain roller 3 in the printing unit 9 is adjusted to the set value RS.

[Determination of Necessity of Intermittent Stop of Ink Feed Operation]

It is subsequently determined in the following manner whether intermittent stop of the ink feed operation should be executed. The CPU 10 determines whether an automatic setting switch 13-2 in a switch group 13 is turned on (step S610). When the operator presses the automatic setting switch 13-2, the CPU 10 resets the count value of a small image portion counter 24 to zero (step S611).

The CPU 10 reads an actual value θ1pv of the ink fountain key opening ratio from a potentiometer 21D of the first ink fountain key (step S612). The CPU 10 also reads out the small image portion determination value θs from a memory M5 (step S613). The actual value θ1pv of the ink fountain key opening ratio is compared with the small image portion determination value θs (step S614). If θ1pv<θs, the count value of the small image portion counter 24 is incremented by one (step S615). If θ1pv≧θs, the flow immediately advances to step S616.

More specifically, if θ1pv<θs, the area of a printing plate 7, which corresponds to an ink fountain key 4-1, is determined as a small image portion. The count value of the small image portion counter 24 is incremented by one. If θ1pv≧θs, the area of the printing plate 7, which corresponds to the ink fountain key 4-1, is determined as a large/medium image portion. The flow immediately advances to step S616 without incrementing the count value of the small image portion counter 24.

In step S616, the CPU 10 reads an actual value θ2pv of the ink fountain key opening ratio from the potentiometer 21D of the next ink fountain key. The CPU 10 also reads out the small image portion determination value θs from the memory M5 (step S617). The CPU 10 compares the actual value θ2pv of the ink fountain key opening ratio with the small image portion determination value θs (step S618). If θ2pv<θs, the area is determined as a small image portion, as in step S615, and the count value of the small image portion counter 24 is incremented by one (step S619). If θ2pv≧θs, the area is determined as a large/medium image portion, and the flow immediately advances to step S620.

In the same way, the CPU 10 repeats the operation in steps S616 to S620 until the read of the actual values θpv of the ink fountain key opening ratios from the potentiometers 21D of all ink fountain keys is confirmed (step S620). With this operation, the counter 24 counts the number of ink fountain keys (the number of small image portions), of all the ink fountain keys 4, which are determined as small image portions because the actual values θpv of the opening ratios are smaller than θs.

The CPU 10 writes a number Km of small image portions counted by the small image portion counter 24 in the memory M12 (step S621). The CPU 10 reads out the small image portion count determination value Ks from a memory M13 (step S622) and compares the number Km of small image portions with the small image portion count determination value Ks (step S623).

If Km≦Ks, the CPU 10 determines that the printing plate 7 set on a plate cylinder 8 in the printing unit 9 has a small number of small image portions, and intermittent stop of the ink feed operation is unnecessary. The series of processing operations are thus ended.

To the contrary, if Km>Ks, the CPU 10 determines that the printing plate 7 set on the plate cylinder 8 in the printing unit 9 has a large number of small image portions, and intermittent stop of the ink feed operation is necessary.

In this case, the CPU 10 reads out a number W of times of stop from a memory M4 (step S624). Set values C1 and C2 are set for a counter 23A and reset counter 23B in an air cylinder driving unit 23 by the processing operations in steps S625 to S627 corresponding to steps S225 to S227 in FIG. 6B to prepare for intermittent stop of the ink feed operation of an ink ductor roller 5 in the printing unit 9.

[Ink Fountain Key Opening Ratio Correction]

The CPU 10 reads an actual value θ1pv of the ink fountain key opening ratio from the potentiometer 21D of the first ink fountain key (step S628). The CPU 10 also reads out the small image portion determination value θs from the memory M5 (step S629). The CPU 10 compares the read actual value θ1pv of the ink fountain key opening ratio with the small image portion determination value θs (step S630). If θ1pv<θs, the flow advances to step S631. If θ1pv≧θs, the flow advances to step S632.

If θ1pv<θs, the area of the printing plate 7, which corresponds to the ink fountain key 4-1, is determined as a small image portion. The actual value θ1pv of the ink fountain key opening ratio, which is read from the potentiometer 21D, is directly written in the memory M20 as θ1pv' (step S631).

If θ1pv≧θs, the area of the printing plate 7, which corresponds to the ink fountain key 4-1, is determined as a large/medium image portion. A correction coefficient α is read out from a memory M7 (step S632). The actual value θ1pv of the ink fountain key opening ratio, which is read from the potentiometer 21D, is multiplied by the correction coefficient α to obtain a correction amount for the actual value θ1pv (step S633).

The correction amount is added to the actual value θ1pv to obtain an ink fountain key opening ratio correction value θ1pv' and writes it in the memory M20 (step S634). With this operation, the actual value θ1pv of the opening ratio of the ink fountain key 4-1 whose corresponding area is determined as a large/medium image portion is corrected such that it increases by the product of the actual value θ1pv and the correction coefficient α.

The CPU 10 reads the actual value θ2pv of the ink fountain key opening ratio from the potentiometer 21D of the next ink fountain key (step S635). The CPU 10 also reads out the small image portion determination value θs from the memory M5 (step S636). The CPU 10 compares the actual value θ2pv of the ink fountain key opening ratio with the small image portion determination value θs (step S637). If θ2pv<θs, the actual value θ2pv is directly written in the memory M20 as θ2pv', as in step S631 (step S638).

If θ2pv≧θs, as in steps S632 to S634, the correction coefficient α is read out from the memory M7 (step S639). The actual value θ2pv is multiplied by the correction coefficient α to obtain a correction amount (step S640). A value obtained by adding the correction amount to the actual value θ2pv is written in the memory M20 as θ2pv' (step S641).

In the same way, the CPU 10 repeats the operation in steps S635 to S641 until the read of the actual values θpv of the ink fountain key opening ratios from the potentiometers 21D of all ink fountain keys is confirmed (step S642). With this operation, the ink fountain key opening ratio correction values θ1pv' to θnpv' are stored in the memory M20.

The ink fountain key opening ratio correction values θ1pv' to θnpv' stored in the memory M20 are not actually corrected when the actual value θpv is smaller than the small image portion determination value θs. The opening ratio correction values θ1' to θn' are corrected when the actual value θpv is larger than the small image portion determination value θs. That is, the actual values θ1 to θn of the opening ratios of the ink fountain keys 4 are not corrected when the corresponding area is a small image portion (θpv<θs). Only for a large/medium image portion (θpv≧θs), the actual values θ1 to θn are corrected to larger values.

When storage of the ink fountain key opening ratio correction values θ1pv' to θnpv' in the memory M20 is ended in step S642, the CPU 10 reads out the ink fountain key opening ratio correction values θ1pv' to θnpv' from the memory M20 (step S643). The readout ink fountain key opening ratio correction values θ1pv' to θnpv' are sent to the motor driver 21A of the ink fountain key driving unit 21 (step S644). The ink fountain key motor 21B is driven to adjust the opening ratios of the ink fountain keys 4 in the printing unit 9 to the correction values θ1pv' to θnpv'.

OPERATION EXAMPLE 2

Intermittent Stop+Ink Fountain Roller Feed Amount Correction

In operation example 1 described above, when the ink feed operation should intermittently be stopped, the actual values θ1pv to θnpv of the ink fountain key opening ratios are corrected in accordance with the image area ratio. In place of the actual values θ1pv to θnpv of the ink fountain key opening ratios, the actual value RSpv of the feed amount of the ink fountain roller 3 may be corrected in accordance with the image area ratio.

In operation example 2 to be described with reference to FIG. 18, the actual value RS of the feed amount of the ink fountain roller 3 is corrected to a larger value. With this operation, the ink supply amount to the large/medium image portion that requires a higher ink fountain key opening ratio is increased as compared to a small image portion that requires a low ink fountain key opening ratio.

Figure 17A:
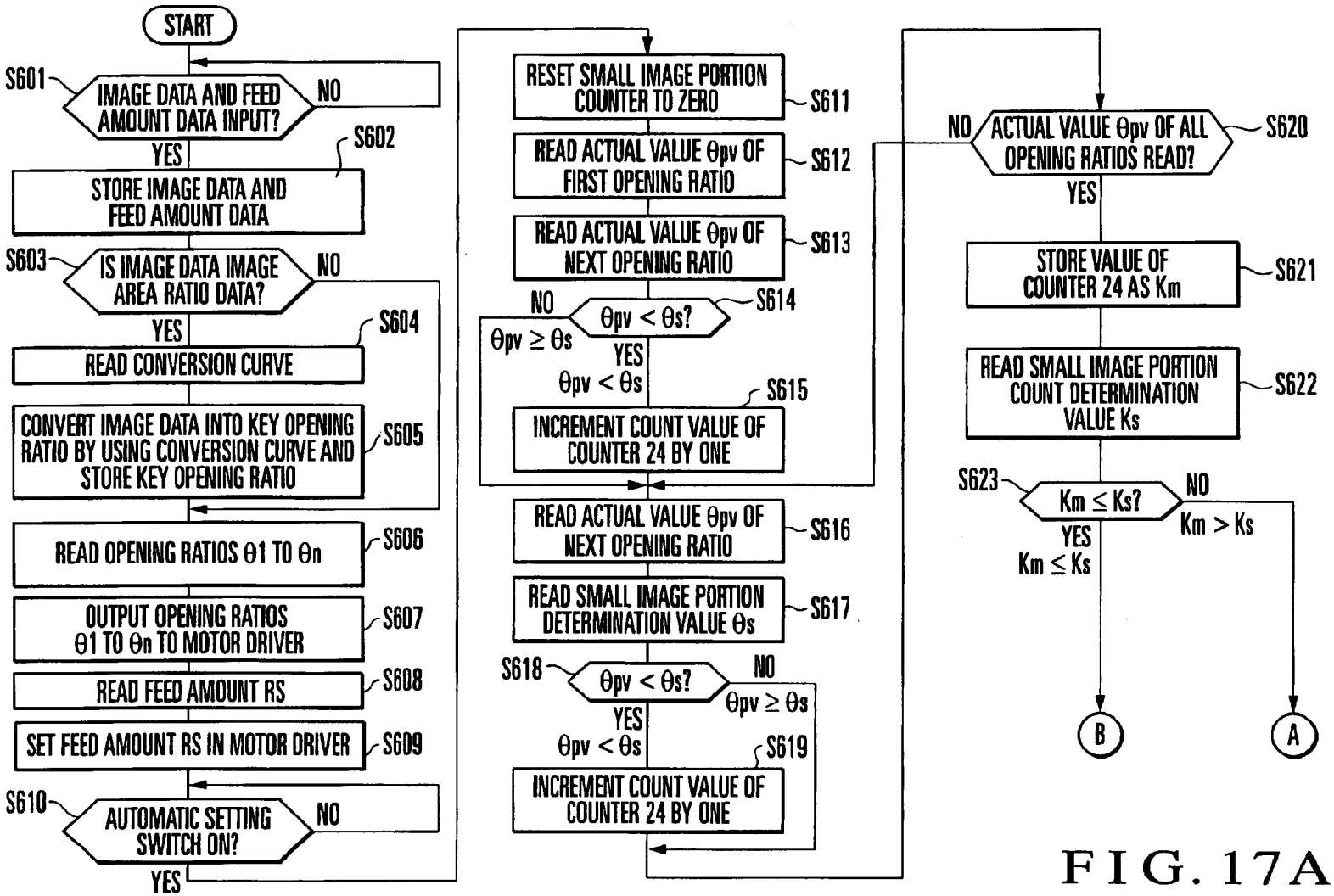
FIGS. 17A and 17B are flow charts for explaining the operation (operation example 1) of the ink supply amount control apparatus shown in FIG. 16 before the start of printing.
Figure 17B:
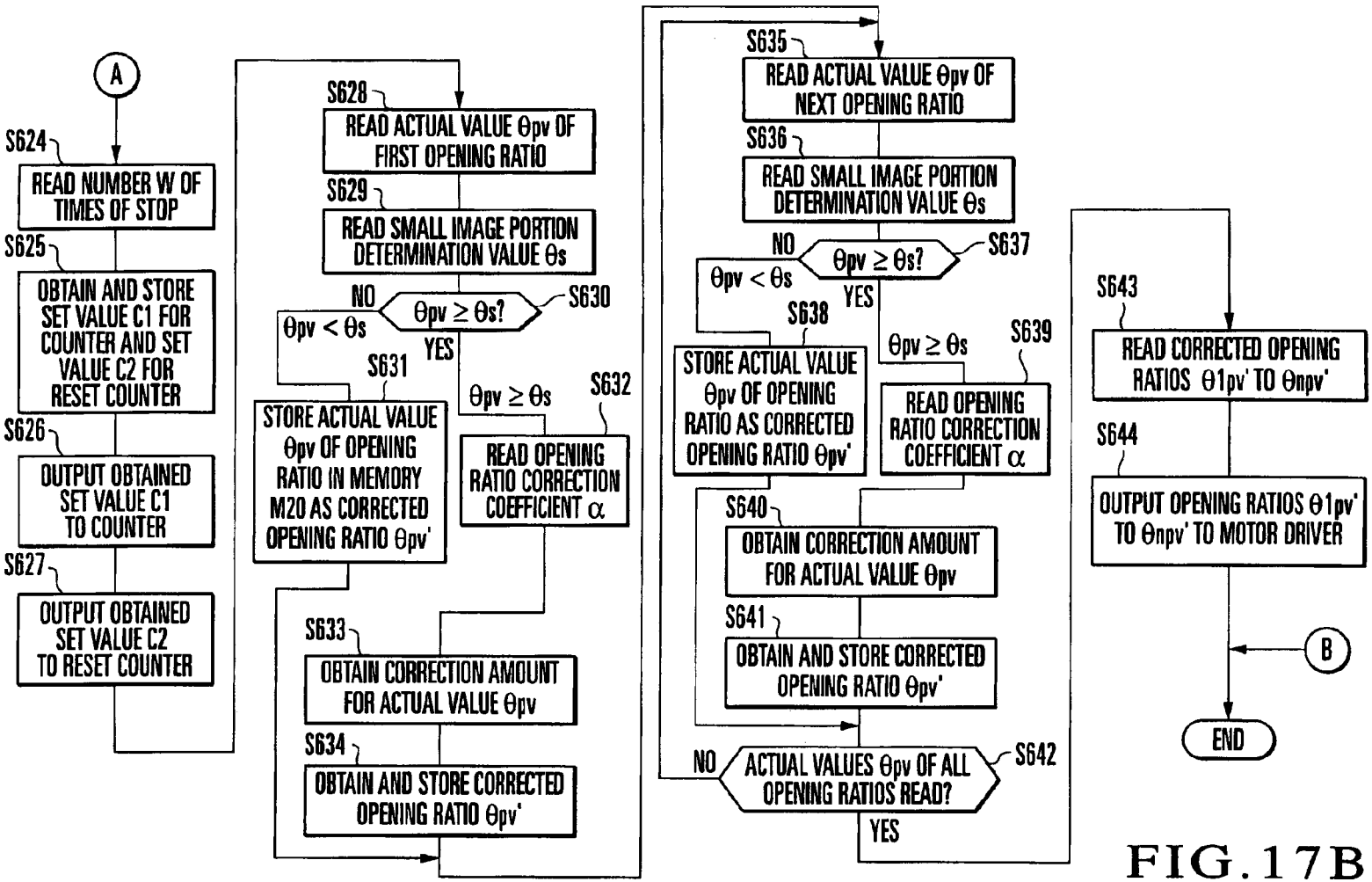
Figure 18:
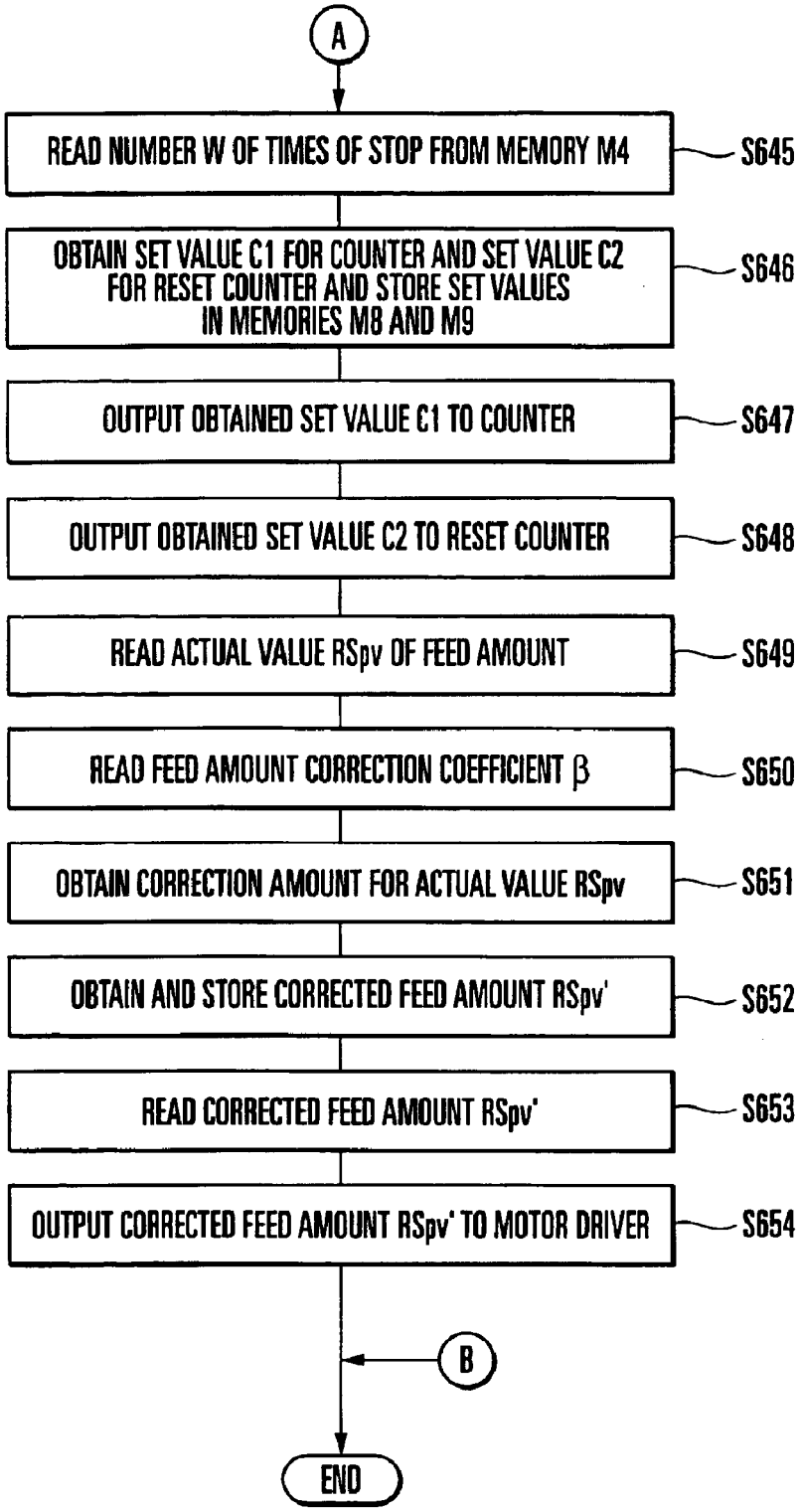
FIG. 18 is a flow chart for explaining the operation (operation example 2) of the ink supply amount control apparatus shown in FIG. 16 before the start of printing.

FIG. 18 follows processing that is executed after NO in step S623 in FIG. 17A. The operation until step S623 is the same as in operation example 1, and a description thereof will be omitted.

When it is confirmed in step S623 that Km>Ks, it is determined that the printing plate 7 set on the plate cylinder 8 in a printing unit 9-1 has a large number of small image portions, and intermittent stop of the ink feed operation is necessary.

In this case, the CPU 10 reads out the number W of times of stop from the memory M4 (step S645), obtains the set value C1 for the counter 23A in the air cylinder driving unit 23 and the set value C2 for the reset counter 23B from the number W of times of stop, and writes the set values in memories M8 and M9 (step S646). The set value C1 is set for the counter 23A, and the set value C2 is set for the reset counter 23B (steps S647 and S648).

The CPU 10 reads the actual value RSpv of the ink fountain roller feed amount from a tachogenerator 22D (step S649). The CPU 10 also reads out a correction coefficient β from a memory M10 (step S650). The CPU 10 multiplies the actual value RSpv of the ink fountain roller feed amount, which is read from the tachogenerator 22D, by the correction coefficient β to obtain the correction amount for the actual value RSpv (step S651). Next, the CPU 10 adds the correction amount to the actual value RSpv of the ink fountain roller feed amount, which is read from the tachogenerator 22D, to obtain an ink fountain roller feed amount correction value RSpv' and writes it in the memory M21 (step S652). Accordingly, the actual value RSpv of the feed amount of the ink fountain roller 3 is corrected to be larger by the product of the actual value RSpv and the correction coefficient β.

The CPU 10 reads out the ink fountain roller feed amount correction value RSpv' from the memory M21 (step S653). The readout ink fountain roller feed amount correction value RSpv' is sent to the motor driver 22A of the ink fountain roller driving unit 22 (step S654). Accordingly, at the time of printing, the feed amount of the ink fountain roller 3 in the printing unit 9 is adjusted to the correction value RSpv'.

Figure 19A:
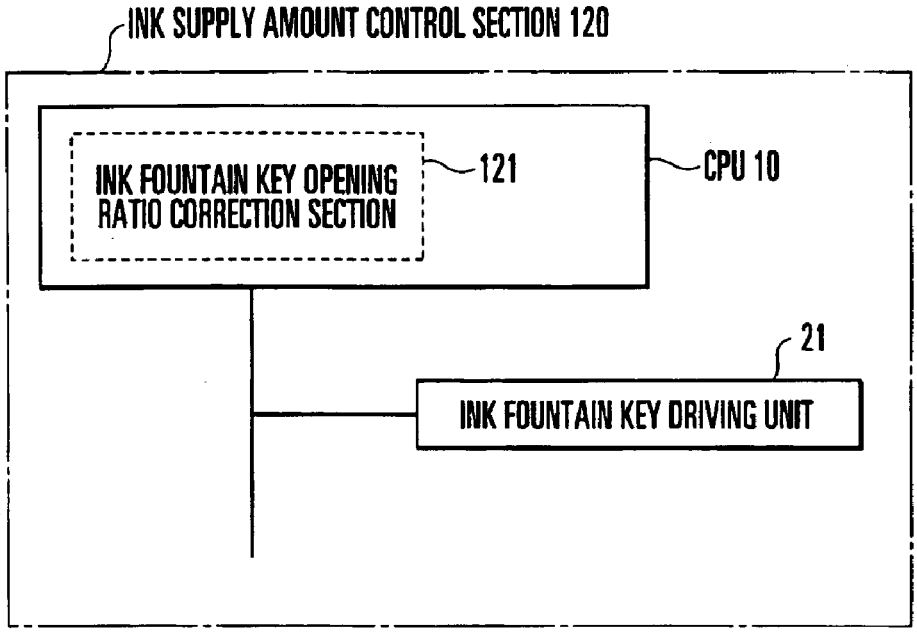
FIGS. 19A and 19B are block diagrams of an ink supply amount control section, which correspond to operation examples 1 and 2, respectively.

In operation examples 1 of the above-described first to sixth embodiments, as shown in FIG. 19A, the CPU 10 has, as a functional block, an ink fountain key opening ratio correction section 121 which sets the ink fountain key opening ratio correction value in accordance with the image area ratio, as described above. The ink fountain key opening ratio correction section 121 and ink fountain key driving unit 21 construct an ink supply amount control section 120. The ink fountain key driving unit 21 adjusts the ink fountain key opening ratio on the basis of the set value corrected by the ink fountain key opening ratio correction section 121.

Figure 19B:
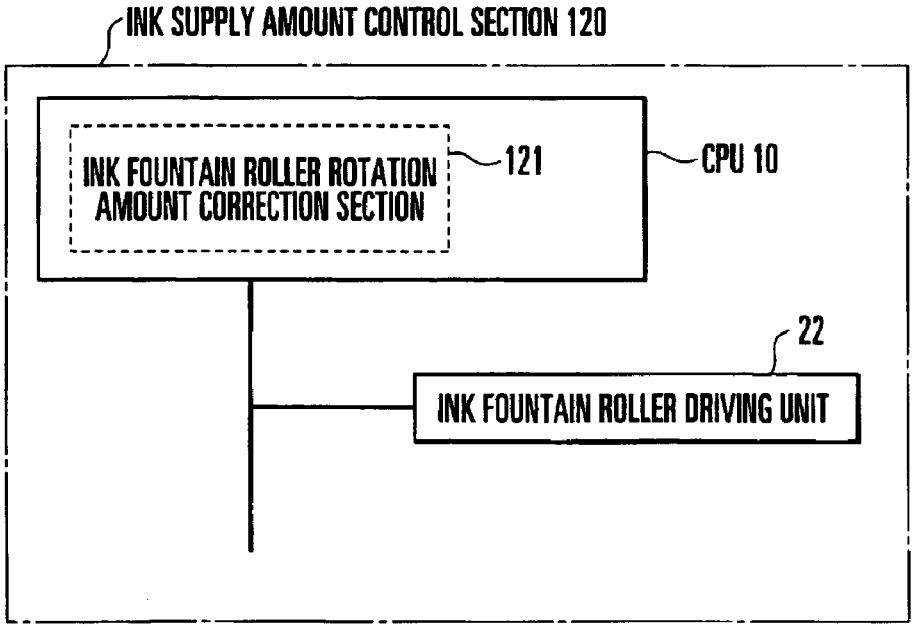

In operation examples 2 of the above-described first to sixth embodiments, as shown in FIG. 19B, the CPU 10 has, as a functional block, an ink fountain roller rotation amount correction section 122 which sets the ink fountain roller rotation amount correction value in accordance with the image area ratio, as described above. The ink fountain roller rotation amount correction section 122 and ink fountain roller driving unit 22 construct the ink supply amount control section 120. The ink fountain roller driving unit 22 rotationally drives the ink fountain roller on the basis of the set value corrected by the ink fountain roller rotation amount correction section 122.

In the above-described first to sixth embodiments, the ink ductor roller 5 is arranged between the ink fountain roller 3 and the ink rollers 6-1. However, one of rollers from the ink fountain roller 3 to the ink form rollers 6-2 may serve as the ink ductor roller that performs the swing operation, and the swing operation of the ink ductor roller may be intermittently stopped.

In the operation example 1, the means (driving cam 27) for periodically swinging the ink ductor roller 5 as the printing press rotates and the means (air cylinder driving unit 23) for stopping the swing operation are formed from separate members (mechanisms). However, the present invention is not limited to this. These means may be formed from an integrated member (mechanism).

As has been described above, according to the present invention, when swing of the ink ductor roller should intermittently be stopped, the gap amount between the ink fountain key and the ink fountain roller (ink fountain key opening ratio) or the rotation amount of the ink fountain roller (ink fountain roller feed amount) is corrected. Since the ink supply amount to a large/medium image portion is increased, the excess ink supply to a small image portion and a shortage of the ink supply amount to a large/medium image portion can simultaneously be solved. In addition, the load on the operator can be reduced.

What is claimed is:

1. An ink supply amount control method for a printing press, characterized by comprising the steps of:

supplying ink from a gap between a plurality of ink fountain keys (4) and an ink fountain roller (3) to an ink supply path in accordance with rotation of the ink fountain roller;

altering a swing operation of an ink ductor roller which is arranged in the ink supply path and swings in synchronism with rotation of printing plate (7) by preventing at least one swing and permitting at least one swing out of each plurality of potential swings;

when a swing operation of the ink ductor roller is prevented, controlling an operation of at least one of the ink fountain key and the ink fountain roller to control an ink supply amount to the ink ductor roller; and supplying ink in a corrected amount to the printing plate attached to a plate cylinder (8) through the ink supply path by the swing operation of the ink ductor roller.

2. A method according to claim 1, wherein the control step comprises the step of correcting a gap amount between the ink fountain keys and the ink fountain roller.

3. A method according to claim 2, wherein the correction step comprises the step of executing correction when the gap amount between the ink fountain keys and the ink fountain roller is larger than a predetermined value.

4. A method according to claim 2, wherein the correction step comprises the step of setting the gap amount between the ink fountain keys and the ink fountain roller to a larger value.

5. A method according to claim 4, wherein the setting step comprises the step of setting a value obtained by multiplying the gap amount between the ink fountain keys and the ink fountain roller by a predetermined correction coefficient.

6. A method according to claim 1, wherein the control step comprises the step of correcting a rotation amount of the ink fountain roller.

7. A method according to claim 6, wherein the correction step comprises the step of setting the rotation amount of the ink fountain roller to a larger value.

8. A method according to claim 7, wherein the setting step comprises the step of setting a value obtained by multiplying the rotation amount of the ink fountain roller by a predetermined correction coefficient.

9. A method according to claim 1, further comprising the steps of counting the number of ink fountain keys for which the gap amount between the ink fountain key and the ink fountain roller falls within a predetermined range, and preventing a swing operation of the ink ductor roller when the counted number of ink fountain keys is larger than a predetermined number.

10. A method according to claim 1, wherein the control step comprises the step of controlling the ink supply amount in accordance with an image area ratio of the printing plate.

11. A method according to claim 1, wherein the stop step comprises the steps of executing a periodical swing operation of the ink ductor roller in synchronism with the rotation of the printing press, and temporarily stopping the periodical swing operation of the ink ductor roller.

12. An ink supply amount control apparatus for a printing press, characterized by comprising:

a plurality of ink fountain keys (4) which are juxtaposed;

an ink fountain roller (3) which is rotatably arranged near said ink fountain keys, said ink fountain roller rotating to supply ink from a gap between said ink fountain keys and said ink fountain roller to an ink supply path;

an ink ductor roller (5) which is arranged in the ink supply path to freely swing and supplies the ink to a printing plate (7) attached to a plate cylinder (8) by a swing operation;

swing control means (25, 23, 27) for preventing at least one swing operation of said ink ductor roller and permitting at least one swing operation of said ink ductor roller out of each plurality of potential swing operations, said potential swing operations occurring in synchronization with a rotation of the printing press; and ink supply amount control means (120) for, when the swing operation of said ink ductor roller is prevented, controlling an operation of at least one of said ink fountain key and said ink fountain roller to control an ink supply amount to said ink ductor roller.

13. An apparatus according to claim 12, wherein said ink supply amount control means comprises correction means (121) for, when the swing operation of said ink ductor roller is prevented, setting a correction value of a gap amount between said ink fountain keys and said ink fountain roller, and ink fountain key driving means (21) for adjusting said ink fountain keys to opening ratios based on the set correction value.

14. An apparatus according to claim 13, wherein said correction means executes a correction operation when the gap amount between said ink fountain keys and said ink fountain roller is larger than a predetermined value.

15. An apparatus according to claim 13, wherein said correction means sets the gap amount between said ink fountain keys and said ink fountain roller to a larger value.

16. An apparatus according to claim 15, wherein said correction means sets the gap amount between said ink fountain keys and said ink fountain roller to a value obtained by multiplying the gap amount by a predetermined correction coefficient.

17. An apparatus according to claim 12, wherein said ink supply amount control means comprises correction means (122) for, when the swing operation of said ink ductor roller is prevented, setting a correction value of a rotation amount of said ink fountain roller, and ink fountain roller driving means (22) for rotationally driving said ink fountain roller on the basis of the set correction value.

18. An apparatus according to claim 17, wherein said correction means sets the rotation amount of said ink fountain roller to a larger value.

19. An apparatus according to claim 17, wherein said correction means sets a value obtained by multiplying the rotation amount of said ink fountain roller by a predetermined correction coefficient.

20. An apparatus according to claim 12, wherein said apparatus further comprises count means (24) for counting the number of ink fountain keys for which the gap amount between said ink fountain key and said ink fountain roller falls within a predetermined range, and said swing control means prevents a swing operation when the count value by said count means is larger than a predetermined value.

21. An apparatus according to claim 12, wherein said ink supply amount control means controls the ink supply amount in accordance with an image area ratio of the printing plate.

22. An apparatus according to claim 12, wherein said swing control means comprises a swing mechanism (27) which executes a periodical swing operation of said ink ductor roller in synchronism with the rotation of the printing press, and a swing stop means (23D) for temporarily stopping the periodical swing operation of said ink ductor roller by said swing mechanism.

23. A method according to claim 1, further comprising the step of obtaining a set value for an opening amount of the ink fountain key or a rotation ratio of the ink fountain roller which is used in the swinging operation of the ink ductor roller when the swinging operation is not altered.

24. An apparatus according to claim 12, wherein said ink supply amount control means further comprises means for obtaining a set value for an opening amount of the ink fountain key or a rotation ratio of the ink fountain roller which is used in the swing operation of the ink ductor roller when the swing operation is not prevented.

* * * * *